United States Patent [19]

Hwang et al.

[11] 4,368,520

[45] Jan. 11, 1983

[54] STEAM TURBINE GENERATOR CONTROL SYSTEM

[75] Inventors: Eddie Y. Hwang, Nether Providence; Andras I. Szabo, Export; Louis G. Ottobre, Murrysville, all of Pa.

[73] Assignee: Westinghouse Electric Corp., Pittsburgh, Pa.

[21] Appl. No.: 191,606

[22] Filed: Sep. 29, 1980

[51] Int. Cl.[3] ..... G06F 15/46; G05B 15/00; F01D 17/02

[52] U.S. Cl. ..... 364/494; 364/181; 364/174; 60/646; 415/17

[58] Field of Search ..... 364/494, 119, 110, 102, 364/103, 181, 184, 174, 176; 290/40 R; 60/646; 415/17

[56] References Cited

U.S. PATENT DOCUMENTS

| | | | |
|---|---|---|---|
| 3,552,872 | 1/1971 | Giras et al. | 415/17 |
| 3,643,437 | 2/1972 | Birnbaum | 290/40 R X |
| 3,741,246 | 6/1973 | Braytenbah | 415/17 X |
| 3,878,401 | 4/1975 | Ronnen | 290/40 R |
| 3,898,441 | 8/1975 | Davis et al. | 290/40 R X |
| 3,939,328 | 2/1976 | Davis | 364/119 X |
| 3,975,622 | 8/1976 | Horn et al. | 364/119 X |
| 4,017,056 | 4/1977 | Schwalenstocker et al. | 91/363 R X |
| 4,025,765 | 5/1977 | Giras et al. | 290/40 R X |
| 4,028,532 | 6/1977 | Reuther | 364/494 |
| 4,029,951 | 6/1977 | Berry et al. | 290/40 R X |
| 4,029,952 | 6/1977 | Giras et al. | 290/40 R X |
| 4,031,372 | 6/1977 | Davis | 290/40 R X |
| 4,035,624 | 7/1977 | Lardi | 290/40 R X |
| 4,071,897 | 1/1978 | Groves, Jr. et al. | 364/494 |
| 4,096,699 | 6/1978 | Zitelli | 415/15 X |
| 4,099,237 | 7/1978 | Zitelli et al. | 364/494 |
| 4,118,772 | 10/1978 | Takada | 364/119 |
| 4,149,235 | 4/1979 | Froyd et al. | 364/101 |
| 4,153,198 | 5/1979 | Eki et al. | 364/494 X |
| 4,166,221 | 8/1979 | McGaha et al. | 290/40 R |
| 4,177,387 | 12/1979 | Malone | 290/40 R |
| 4,179,742 | 12/1979 | Stern et al. | 364/494 |
| 4,205,380 | 5/1980 | Braytenbah | 364/494 |
| 4,263,647 | 4/1981 | Merrell et al. | 364/119 X |
| 4,280,060 | 7/1981 | Kure-Jensen et al. | 364/494 X |

*Primary Examiner*—Edward J. Wise
*Attorney, Agent, or Firm*—D. Schron

[57] ABSTRACT

A turbine control system which includes dual controllers having microcomputer processing circuits and capable of transmitting and receiving digital information to and from a plurality of valve position control circuits, also including their own microcomputer circuitry for controlling turbine steam admission valves. An operator's panel provides for two levels of automatic control as well as a manual backup which is communicative directly with all of the valve position control circuits. Overspeed protection control as well as fast valving is provided by redundant speed control circuits.

36 Claims, 20 Drawing Figures

50
OPERATORS PANEL
96
CONTROLLER
70B
CONTROLLER SELECTOR
90
71
CONTROLLER
70A
86
85
OPC
79
OVERSPEED PROTECTION CONTROLLER (OPC)
78
GATE
81
83
VPC
75-M
75-2
75-1
74-N
74-2
74-1
VALVE POSITION CONTROL (VPC)
VALVE POSITION CONTROL SIGNALS

| STATES | | A CONTROLLER | B CONTROLLER | CONTROL MODE |
|---|---|---|---|---|
| POWER-UP/RESTART | $S_1$ | UNAVAILABLE | UNAVAILABLE | MANUAL |
| | $S_2$ | STAND-BY | UNAVAILABLE | MANUAL |
| | $S_3$ | STAND-BY | STAND-BY | MANUAL |
| | $S_4$ | UNAVAILABLE | STAND-BY | MANUAL |
| $S_5$ | | ON-LINE | UNAVAILABLE | MANUAL |
| $S_6$ | | ON-LINE | STAND-BY | MANUAL |
| $S_7$ | | STAND-BY | ON-LINE | MANUAL |
| $S_8$ | | UNAVAILABLE | ON-LINE | MANUAL |
| $S_9$ | | ON-LINE | UNAVAILABLE | AUTO |
| $S_{10}$ | | ON-LINE | STAND-BY | AUTO |
| $S_{11}$ | | STAND-BY | ON-LINE | AUTO |
| $S_{12}$ | | UNAVAILABLE | ON-LINE | AUTO |

FIG.16B

| TRANSFER ACTIVATIONS | |
|---|---|
| 1 | A DCS DE-ENERGIZED |
| 2 | A DCS ENERGIZED |
| 3 | A SELECT PB DEPRESSED |
| 4 | B DCS DE-ENERGIZED |
| 5 | B DCS ENERGIZED |
| 6 | B SELECT PB DEPRESSED |
| 7 | MANUAL PB DEPRESSED |
| 8 | AUTO PB DEPRESSED |

FIG.16C

STEAM TURBINE GENERATOR CONTROL SYSTEM

BACKGROUND OF THE INVENTION

1. Field of the Invention

The invention in general relates to steam turbine control systems and more particularly to a control system having redundant features coupled with a manual backup.

2. Description of the Prior Art

A variety of turbine control systems exist which utilize a central digital computer to govern steam admission by control of a plurality of steam admission valves, as well as stop and interceptor valves in those systems which include a reheater section between a high pressure and lower pressure turbine stage.

The centralized computer is responsive to various operating parameters to generate the necessary control signals, and, to provide for more reliable service, systems have been proposed which utilize both a primary and a redundant computer as well as a manual backup system. These centralized systems tend to be extremely complex and present difficulties in field servicing. The complexity is significantly increased if capabilities other than basic control are required, thus limiting the expansion capabilities of the control system.

In such turbine control systems an operator's panel is generally provided for operator interaction with the system with the panel including both a manual section and an automatic section. Any servicing of the automatic section requires the complete shutting down of the automatic control mode and a switching to the manual mode of operation just to perform the panel servicing.

While in a manual backup mode, the steam admission valve drive circuits receive control signals as dictated by the operator. These signals generally go to some common logic circuitry and then to the valve controllers such that a failure in the common logic circuitry prevents the valve controller from operating properly.

Overspeed protection control functions are generally provided in such systems for shutting down the valves or tripping the turbine system depending upon the degree of overspeed. A failure of this control circuit or a miscalculation in speed could result in undesirable operation of the system.

The above numerated difficulties are significantly reduced or eliminated with the control system of the present invention.

SUMMARY OF THE INVENTION

The present turbine control system is divided into several interconnected and coordinated functional modules such that each functional module has its own digital processing capability to execute its specific function. A failure of any module would lose only that particular function, causing some degradation of operation but with much less impact on the overall system.

The system includes a controller which has a memory means for storing digital information inluding data and operating instructions as well as digital processing circuitry for processing the information. A plurality of steam admission valve position control circuits are provided each operable to generate an output valve position control signal for a respective one of a plurality of valve actuation circuits. Each valve position control circuit includes input means for receiving digital information signals from the controller and further includes memory means for storing digital information including data and operating instructions and digital processing circuitry for processing this information. To further increase reliability of operation, a second or redundant controller, identical to the first controller is provided.

At least two channels of overspeed protection control is included with each channel receiving at least three input speed signals, one of the speed input signals being derived from the other channel. In this manner a much more reliable speed signal may be generated, and proper overspeed protection may still be provided even in the event of failure of one of the speed channels.

An operator's panel contains a manual section, for manual backup purposes, and two distinct automatic sections, one providing the essential functions for maintaining the system in an automatic control mode while the other contains a greatly expanded capability for extensive operator interaction. With this arrangement, the system may remain in the automatic control mode of operation even if one of the automatic sections of the operator's panel has to be removed for servicing.

BRIEF DESCRIPTION OF THE DRAWINGS

FIG. 16B is a table defining the various states of FIG. 16A;

FIG. 16C is a table defining the necessary actions to transfer between states;

DESCRIPTION OF THE PREFERRED EMBODIMENT

Figure 1:
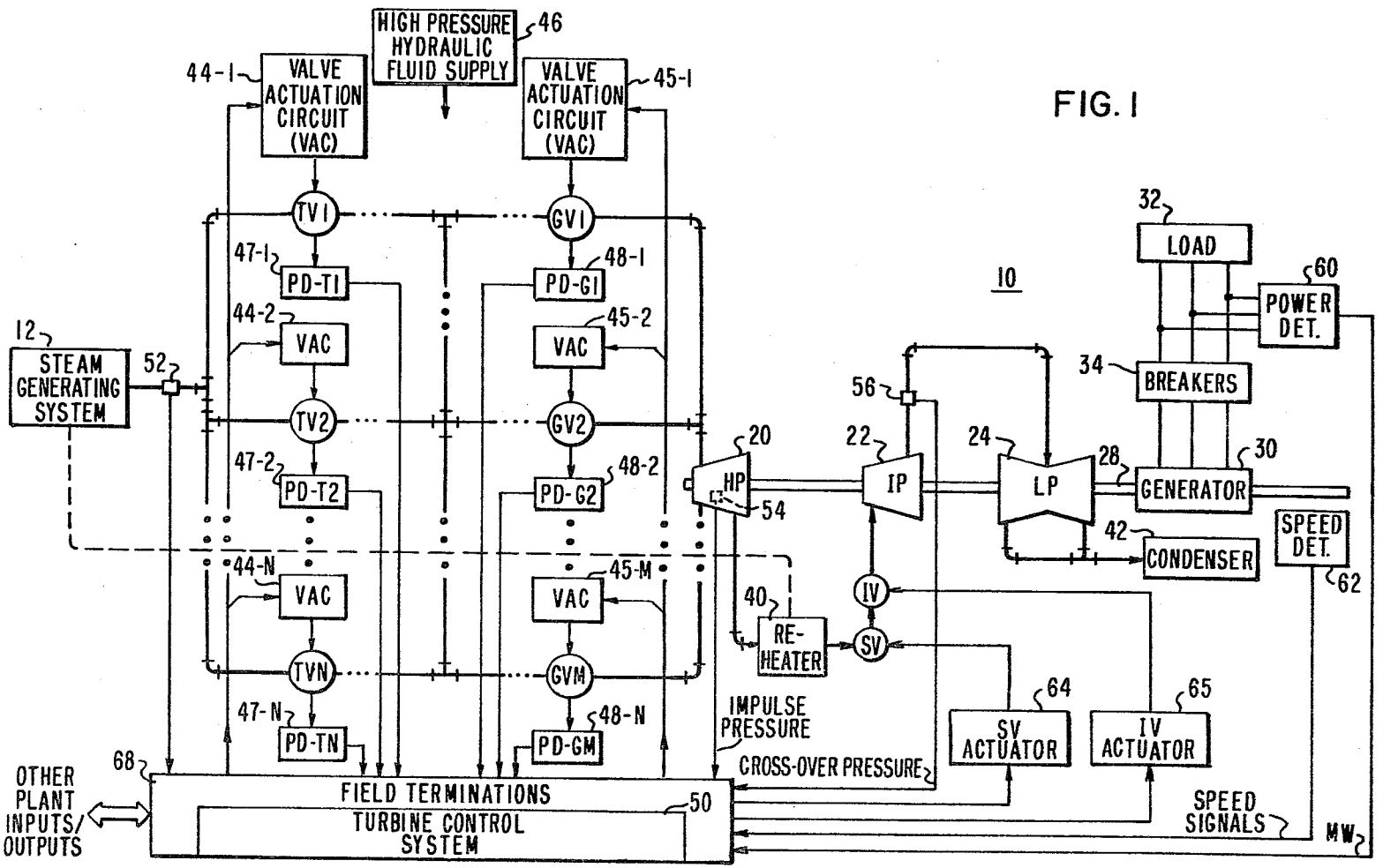
FIG. 1 is a block diagram of a turbine system.

Although the invention is applicable to a variety of steam turbine-generator systems it will be described by way of example with respect to a fossil fired, tandem-compound single re-heat turbine generator unit as illustrated in FIG. 1. In a typical steam turbine-generator power plant as illustrated in FIG. 1 there is provided a plurality of steam admission valves such as throttle valves TV1 to TVN and governor valves GV1 to GVM disposed in the main steam header which couples a steam turbine 10 to a steam generating system 12. In a typical arrangement there may be four throttle valves (N=4) and eight governor valves (M=8).

Turbine 10 includes a high pressure (HP) turbine section 20, an intermediate pressure (IP) turbine section 22 and a low pressure (LP) turbine section 24, all of which are coupled to a common shaft 28 to drive an electrical generator 30 which supplies power to a load 32 through main breakers 34.

Steam exiting the HP turbine section 20 is normally reheated in a reheating unit 40 and thereafter supplied to IP turbine section 22 through one or more stop valves SV and one or more interceptor valves IV disposed in the steam line. Steam from the IP turbine section 22 is provided to LP turbine section 24 from which the steam is exhausted into a conventional condenser 42.

With the main breakers 34 open, the torque as produced by the inlet steam is used to accelerate the turbine shaft 28 from turning gear to synchronous speed. As long as the main breakers 34 are open the turbine is spinning with no electrical load and it is operative in a speed control mode. Once the shaft frequency is synchronized to the frequency of the load 32, which may be a power system network, the breakers 34 are closed, and power is delivered to the load by the generator 30. With the breakers 34 closed the net torque exerted on the turbine rotating assemblies of the HP, IP and LP turbine sections controls the amount of power supplied to the load 32, while shaft speed is governed by the frequency of the power system network. Control of steam inlet under these conditions is generally referred to as load control, during which the turbine speed is monitored for purposes of regulating the power delivered to the load 32.

In order to control the turbine during operation, the steam admitting throttle and governor valves are controlled in position by respective valve actuation circuits 44 and 45 which receive high pressure fluid from a high pressure hydraulic fluid supply 46. Thus, valve actuation circuits 44-1 through 44-N respectively control throttle valves TV1 through TVN and valve actuation circuits 45-1 through 45-M control governor valves GV1 through GVM.

Position detectors 47 and 48 are coupled to the valves to provide respective feedback signals indicative of valve position. Position detectors 47-1 through 47-N are coupled to respective throttle valves TV1 through TVN and position detectors 48-1 through 48-M are coupled to respective governor valves GV1 through GVM.

Control signals for operation of the valve actuation circuits are derived from a turbine control system 50 which utilizes indications of various plant parameters for control purposes. Among the various parameters utilized is an indication of throttle pressure derived from a throttle pressure detector 52 in the main steam line between the steam generating system 12 and the throttle valves. A detector 54 within the HP turbine section 20 provides an indication of impulse pressure and a detector 56 in the crossover line between IP and LP turbine sections 22 and 24 provides an indication of crossover pressure. A power detector 60 coupled to the generator output provides a megawatt (MW) signal indicative of output electrical power. An additional input utilized by the turbine control system 50 is an indication of speed which is obtained by speed detection circuitry 62 which in a preferred embodiment is operable to provide three redundant speed signals.

In addition to controlling the valve actuation circuits for the throttle and governor valves, the turbine control system 50 is also operable to control the opening and closing of the stop valves and interceptor valves by respective valve actuation circuits 64 and 65.

In accordance with a preferred embodiment of the present invention selected input signals to the turbine control system from the plant, as well as output signals to the plant are coupled to field termination networks 68 so as to provide for signal conditioning and surge voltage protection.

Figure 2:
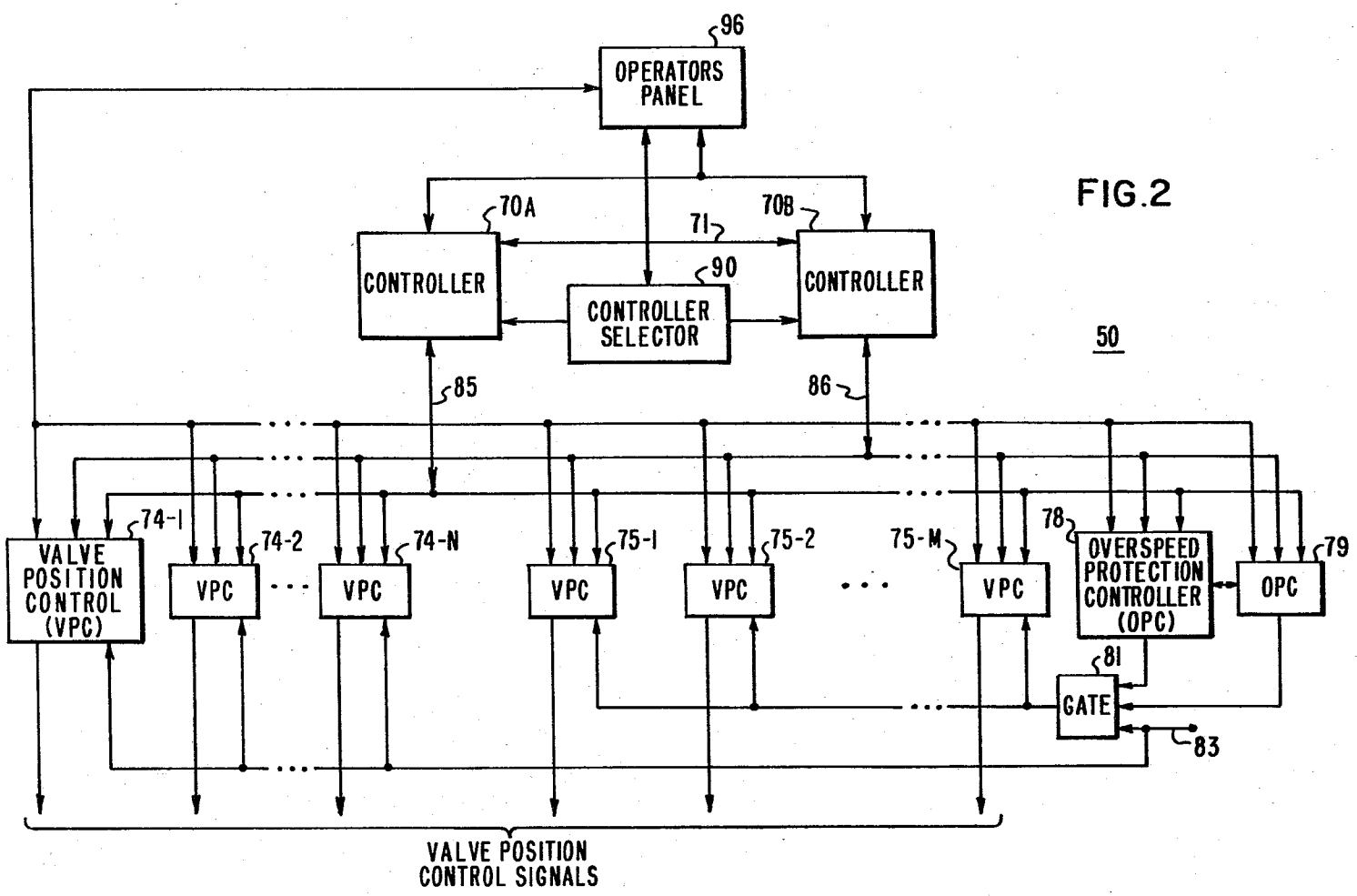
FIG. 2 is a block diagram of the turbine control system illustrated in FIG. 1.

A block diagram of a turbine control system 50 in accordance with the preferred embodiment of the present invention is illustrated in FIG. 2. The system includes a controller 70A having memory means for storing digital information including data and operating instructions. Digital processing circuitry is provided for processing the digital information and the controller includes means for inputting and outputting information. The reliability of the system may be improved by incorporating a second controller 70B having the indentical structure as controller 70A.

The hardware complexity of the digital system is simplified in the present invention by physically dividing the system into several interconnecting and coordinated functional modules such that each functional module has processing capability to execute its specific function. In FIG. 2 the functional modules include valve position control circuits 74 and 75 for controlling respective throttle valve and governor valve actuation circuits. Thus valve position control circuits 74-1 through 74-N provide control signals to valve actuation circuits 44-1 through 44-N and constitute throttle valve position control circuits, and valve position control circuits 75-1 through 75-M control respective valve actuation circuits 45-1 through 45-M and constitute governor valve position control circuits. Each such control circuit includes its own memory means for storing digital information including data and operating instructions, as well as digital processing circuitry for processing the digital information.

Speed monitoring and protection is provided by an overspeed protection controller (OPC) circuit 78 which, like the valve position control circuits 74 and 75, includes its own memory means for storing digital information including data and operating instructions, and digital processing circuitry for processing this digital information. The reliability of the speed protection operation may be further improved by the incorporation of a second channel of overspeed protection in the form of OPC circuit 79 identical to OPC circuit 78 and in signal communication therewith. The OPC circuits 78 and 79 are operable to interact directly with the governor valve position control circuits 75 through gate circuit 81 to initiate a closing of all the governor valves upon a certain predetermined condition. This closing may also be effected by means of an external signal applied at lead 83, such signal being for example a turbine trip signal which is provided to gate 81 and to valve position control circuits 74-1 through 74-N.

By means of digital data links 85 and 86 digital information is conveyed from the valve position control and OPC circuits to both controllers 70A and 70B whereas only one selected controller 70A or 70B transmits digital information down to the valve position control and OPC circuits. A controller selector 90 is operable to determine which controller is the primary controller and which is the backup controller and may be further operable to selectively choose data link 85 or 86 for downward transmission of digital information.

The turbine control system additionally includes an operator's panel 96 in two way communication with both controllers 70A and 70B as well as with all of the valve position control and OPC circuits. This latter connection enables various parameters to be communicated to the operator and allows the operator to place the system under direct manual control.

CONTROLLER

Structurally, controllers 70A and 70B are identical and are programmed to perform many conventional routines as is performed by various prior art digital control circuits. For example, each controller may evaluate the flow demand according to established set points and rates of change and modified by various feedback signals such as throttle pressure, impulse pressure, speed and MW values. The controller can determine by well known valve control programs the required control signals to the individual valves in order to satisfy flow demand in throttle valve control, governor valve single valve control or governor valve sequential valve control modes of operation.

During speed control and load control operations, each controller may provide for bumpless transfers from throttle valve to governor valve control and from single to sequential governor valve control and vice versa.

Figure 3:
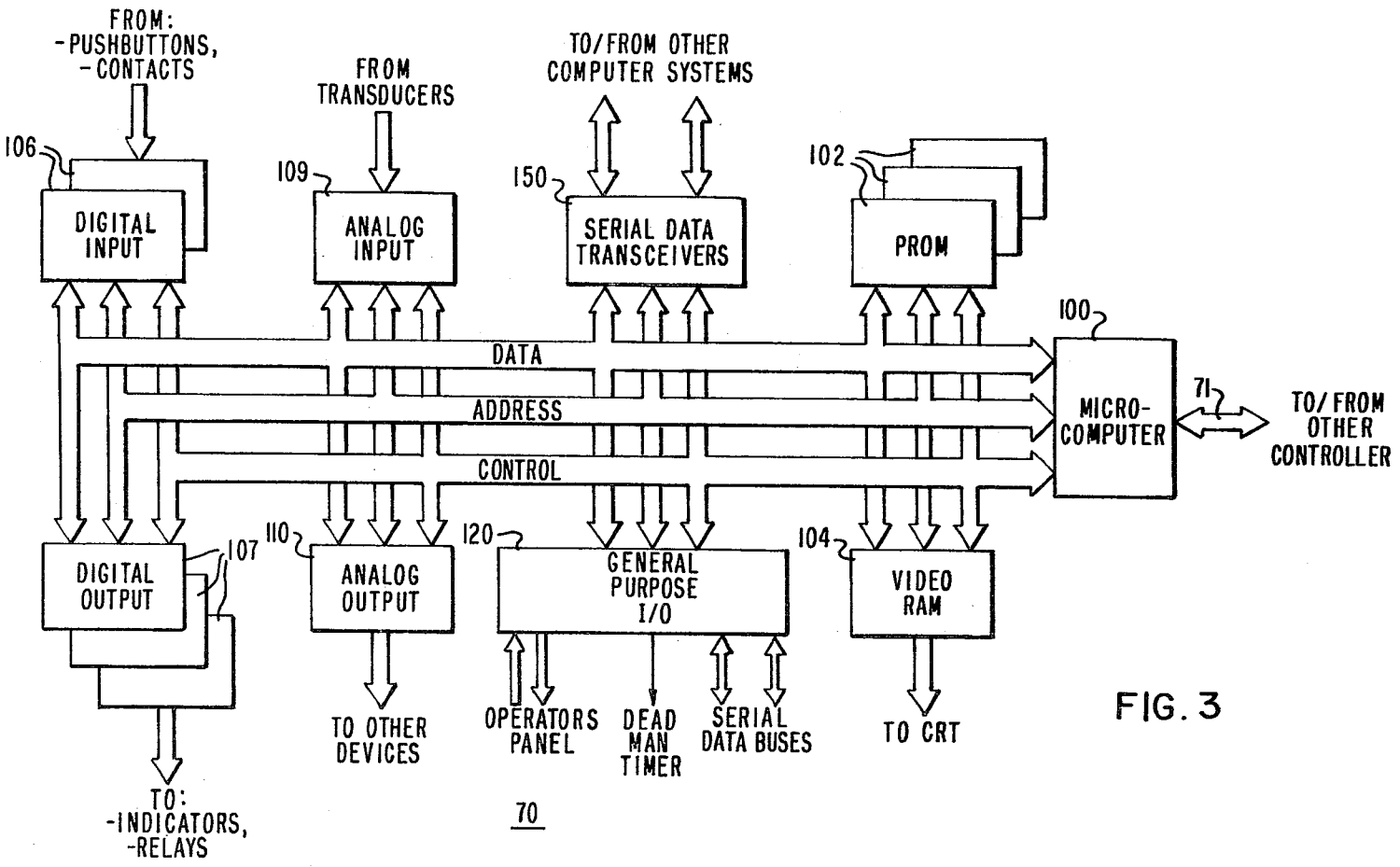
FIG. 3 is a block diagram of a typical controller illustrated in FIG. 2.

In addition to providing for numerous different testing operations, including self tests, the controllers constantly track and communicate with each other to enable bumpless control transfer at any time by the operator or by an automatic transfer in case of a malfunction. The controller structure is easily expandable to accommodate other present or future control or test operations as well as being expandable for communication with other computer systems. A typical controller 70 is illustrated in FIG. 3.

The heart of the controller 70 is a microcomputer 100 which communicates with a plurality of other units by means of the data, address and control buses illustrated to form an expanded microcomputer. Microcomputer 100 may be a commerically available item produced by the Motorola Corporation under their designation M68MM19 which is a microcomputer having a microprocessing unit, input/output (I/O) units and a random access memory (RAM) for storing data. Controller 70 additionally includes programmable read only memory (PROM) means for storing for example, various operating instructions for carrying out different programs. Three such PROMs 102 are illustrated in FIG. 3 although the system may be expanded to accommodate more. One example of a PROM which may be utilized is the Motorola M68MM04-1.

In a preferred embodiment of the present invention the operator's panel 96 (FIG. 2) will have a cathode ray tube (CRT) display. The display format is computer controlled and accordingly a RAM 104 is provided specifically for controlling the CRT. A typical video RAM is one produced by the Matrox Corporation under their designation EXO-2480.

A typical turbine system has many relay operated contacts, the status of which represents the attainment (or nonattainment) of certain conditions. For example, these contacts include turbine latch contacts, remote contacts for load runbacks, and circuit breaker engaged contacts, to name a few. The open or closed state of these contacts is equivalent to a digital 1 or 0 signal which is inputted to the controller. Additionally the operator's panel includes various pushbuttons which also provide digital 1 or 0 input signals. The controller in its normal operation will generate certain digital 1 or 0 signals to operate relays to open or close certain contacts such as contacts relating to indications of overspeed, turbine trip, motoring, power failure, automatic control availability, as well as numerous annunciator contacts. Accordingly, in order to input and output this digital information, controller 70 includes digital input circuits 106 and digital output circuits 107. The input or output function may be accomplished with a digital input output circuit produced by the Motorola Corporation under their designation M68MM03.

In addition to digital input signals the controller also receives analog input signals such as analog signals from various transducers and various set points provided as analog input signals from external equipment. In an expanded turbine control system which includes one or more higher order computer controllers, it may be necessary to output analog information to these higher order controllers. Accordingly the controller 70 of FIG. 3 includes, for inputting and outputting of analog information, an analog input circuit 109 such as the Motorola M68MM05A, and an analog output circuit 110 such as the Motorola M68MM15CI.

Figure 4:
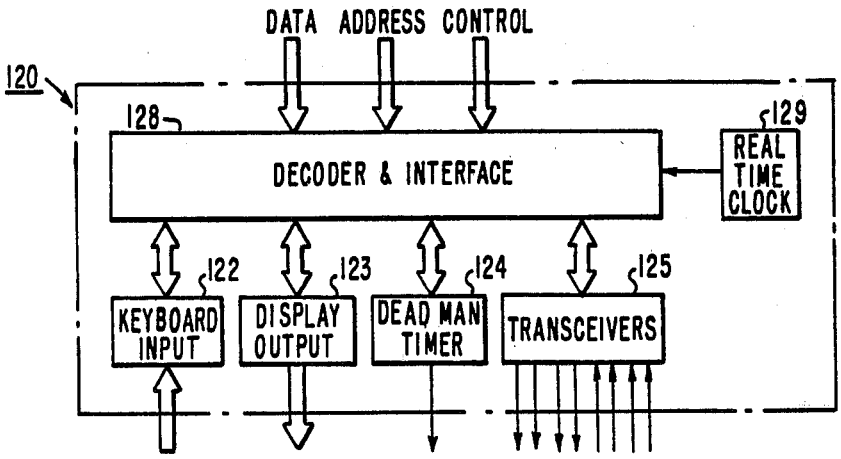
FIG. 4 is a block diagram further illustrating the details of one of the circuits of FIG. 3.

In order to accommodate for the transfer of digital information between the controller and the various units illustrated in FIG. 2, such as the operator's panel 96, valve position control circuits 74 and 75, OPC circuits 78 and 79, and the controller selector 90, there is provided a general purpose I/O circuit 120. Whereas the controller circuits previously described are standard off the shelf items, the general purpose I/O circuit 120 is specially fabricated for providing its function, however it is fabricated with standard well known circuits as illustrated in the block diagram of FIG. 4.

As will be described, the operator's panel includes a keyboard for operator entry of certain information. Controller 70 is operable to periodically scan the keypads to see which ones, if any, have been depressed. The general purpose I/O circuit 120 includes a keyboard input circuit 122 operatively connected with the keyboard of the operator's panel for receiving the operator entered information.

The operator's panel also includes a display which is formatted by digital signals from the controller. Accordingly, the display output circuit 123 is provided for interfacing with the display.

Various computer systems include circuitry for providing an output signal indicating that the computer is operational. This signal is sometimes referred to as a dead man timer signal and circuit 124 is operable to provide such dead man timer signal in the present arrangement.

Digital information is conveyed between the controller and the valve position control and OPC circuits by means of the transceiver arrangement 125, the inputs and outputs of which constitute the digital data links 85 or 86 shown in FIG. 2. The unique addressing of circuits 122 through 125 and the transfer of information to and from these circuits is accomplished with the decoder and interface circuit 128. In addition, the general purpose I/O circuit 120 includes its own real time clock 129 for governing sample rates as well as for governing the output of the dead man timer 124.

Figure 5:
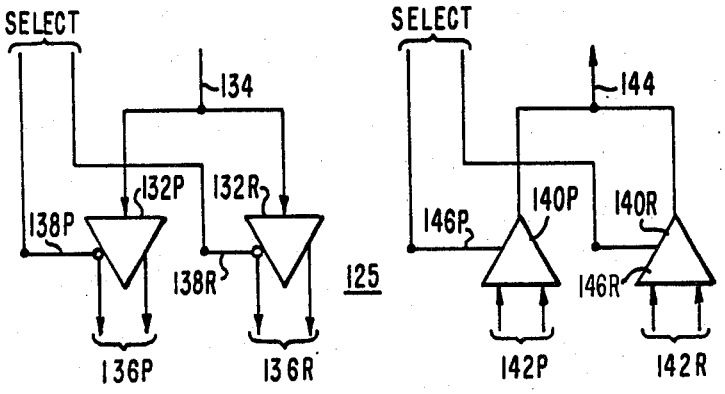
FIG. 5 is a circuit diagram illustrating the transceiver arrangement of FIG. 4 in more detail.

The transceiver arrangement 125 is illustrated in more detail in FIG. 5. In the present arrangement data is transmitted serially between the controller and valve position control and OPC circuits by means of primary and redundant differential line drivers and receivers. Thus in FIG. 5 a primary driver 132P and redundant driver 132R are arranged to receive the same digital input signal on line 134 for transmission on either balanced line 136P or 136R depending upon which driver is supplied with an enabling signal by microcomputer 100, at gate 138P or 138R. In one mode of operation both drivers may be enabled for simultaneous transmission of the same data signal.

The receiver portion of the transceiver includes a primary balanced line receiver 140P as well as a redundant receiver 140R respectively receiving digital signals on balanced lines 142P and 142R. A selected one of the receivers will output the digital information on line 144 depending upon which one is supplied with an enabling signal by microcomputer 100 at gate 146P or 146R.

Referring once again to FIG. 3, in many arrangements it may be desirable to have controller 70 communicate with other higher order computer systems. Data flow between these other systems and controller 70 may be accomplished with the provision of serial data transceivers 150 such as that produced by the Motorola Corporation under their designation M68MM07.

VALVE ACTUATION CIRCUIT

Figure 6:
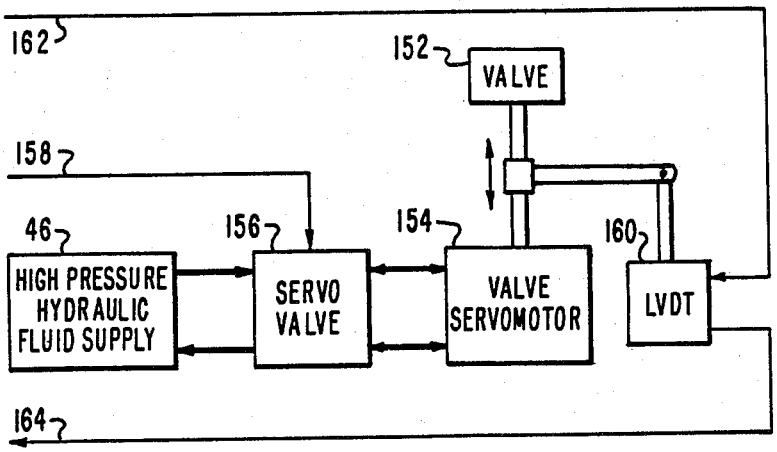
FIG. 6 is a block diagram illustrating a typical valve control arrangement.

As illustrated in FIG. 1 the turbine control system 50 (and more particularly the valve position control circuits 74 and 75 thereof) provides control signals to valve actuation circuits 44 and 45. One example of a valve actuation circuit which is in common use is illustrated in more detail in FIG. 6.

Very basically, valve 152 which may represent a throttle valve or governor valve is position controlled by means of a valve servomotor 154 which may be an hydraulic piston valve actuator. Movement of the piston within servomotor 154 is governed by the provision of high pressure fluid from the hydraulic fluid system 46 as modulated by the servovalve 156. A control signal on line 158 governs the movement of servovalve 156 and as a result thereof, the positioning of valve 152. For simplicity of explanation, fluid lubrication and trip circuits are not illustrated.

A position detector may take the form of a linear variable differential transformer (LVDT) 160 which is provided with an excitation signal on line 162 to generate in a well-known manner, a feedback position signal on line 164 indicative of valve position. A typical valve position control circuit for controlling valve 152, be it a throttle valve or governor valve, is illustrated in more detail in FIG. 7.

VALVE POSITION CONTROL CIRCUIT

Each valve position control circuit 74 or 75 has a memory for storing digital information including data and operating instructions, as well as digital processing circuitry for processing the digital information. The memory means and digital processing circuitry are contained in microcomputer control circuit 170.

The valve position control circuit 74 or 75 is communicative with both controllers 70A and 70B by means of the digital data link comprised of the primary and redundant balanced lines 136P and 136R for transmission of information from a selected controller to the valve position control circuits and along primary and redundant balance lines 142P and 142R for transmission of information back to the controllers. The transceiver arrangement 171 of the valve position control circuit includes primary and redundant receivers 172P and 172R as well as primary and redundant drivers 174P and 174R. Enabling signals to gates 176P and 176R as well as to gates 178P and 178R determine which receivers and which drivers are operative for the information interchange.

Other inputs to the valve position control circuit include that from an identification (ID) circuit 180 having a plurality of lines, individual ones of which may be selectively grounded so as to provide a binary identification for the particular valve position control circuit.

Contact closure input circuit 182 receives a plurality of inputs from the manual control section of the operator's panel. By way of example these inputs include a MANUAL input on line 184, a RAISE input on line 185, a LOWER input on line 186, a FAST RATE input on line 187 and a RAPID CLOSE input on line 188. A RUNBACK input on line 189 may emanate from a remote contact indicating that the steam supply to the turbine should be reduced, and line 190 receives a CLEAR input. If the valve position control circuit is a control circuit for a governor valve the CLEAR signal input may emanate from one of the OPC circuits 78 or 79 or from a turbine trip contact signal on line 83 (FIG. 2). If the valve position control circuit is for a throttle valve, the CLEAR signal on line 190 is the turbine trip signal on line 83 (FIG. 2).

In operation, a selected one of the controllers 70A or 70B will compute, in response to a set point input, and in accordance with a well known valve management program, a plurality of control signals for the respective valves. The control signals are transmitted from the chosen controller down the digital data link and each signal is preceded by a particular identification number so that a particular control signal is received by only that valve position control circuit which is properly identified. The control signal, in digital form, is accepted by the properly addressed valve position control circuit and placed within the memory of the microcomputer control circuit 170. Under a computer program control, the control signal is provided to the analog-to-digital (A/D) and digital-to-analog (D/A) conversion circuits 194 where the digital control signal is converted to an analog voltage which is provided to driver 196 which in turn provides an output control signal on line 158 to the servovalve 156 of FIG. 6 as long as contact DMT-1 remains closed.

An LVDT excitation circuit 198 provides an output on line 162 for proper operation of the LVDT position sensor 160, the feedback position signal of which, on line 164, is received by demodulator 200. In order to be operable with a variety of different LVDT sensors, an LVDT zero adjust circuit 202 and LVDT gain adjust circuit 204 are provided such that the output of this latter circuit constitutes an analog valve position signal. This analog valve position signal is provided to conversion circuits 194 to convert it to a digital format where under computer program control it is compared with the control signal from the controller and any differential error is utilized to drive the valve to a position so as to reduce the error to within some acceptable range.

Preferably, use is made of a well-known proportional plus integral algorithm which basically provides an integrating function in the control in order to reduce the position error to zero. This is accomplished by taking the error signal and adding to it a proportional signal derived from the trapezoidal equation $$Y_1 = H/2\tau(kE_1 + kE_2) + Y_O$$

where:

$Y_1$ = new calculated value
H = sample period
$\tau$ = time constant
k = gain constant
$E_1$ = new error signal
$E_2$ = old error signal
$Y_0$ = last calculated value A digital representation of valve position may be communicated to controllers 70A and 70B by means of driver 174P or 174R (or both if desired). Provision is also made for supplying an analog representation of valve position for display on a calibration panel meter, as will be explained. For this purpose, a meter driver 210 receives the output analog signal from LVDT gain circuit 204, and indicative of the valve position, and provides this indication on line 212. Similarly it may also be desired to have an indication of the drive voltage, and accordingly the analog input to driver 196 is also provided to the meter driver 210, the output line 213 of which is the drive voltage indication.

The dead man timer circuit 216 periodically receives an input signal from the microcomputer control circuit 170, when this latter circuit is operating correctly, to in turn provide an output signal on line 218 indicating normal and proper operation of the valve position control circuit. An indicating light 120 is connected between line 218 and a source of positive potential and remains in an off condition as long as the dead man timer 216 provides an output signal. Should a malfunction occur such that the signal on line 218 is no longer provided, light 120 will energize indicating a malfunction. Additionally when the dead main timer signal is removed, contact DMT-1 will open to effectively remove that card from the valve control function.

Figure 7:
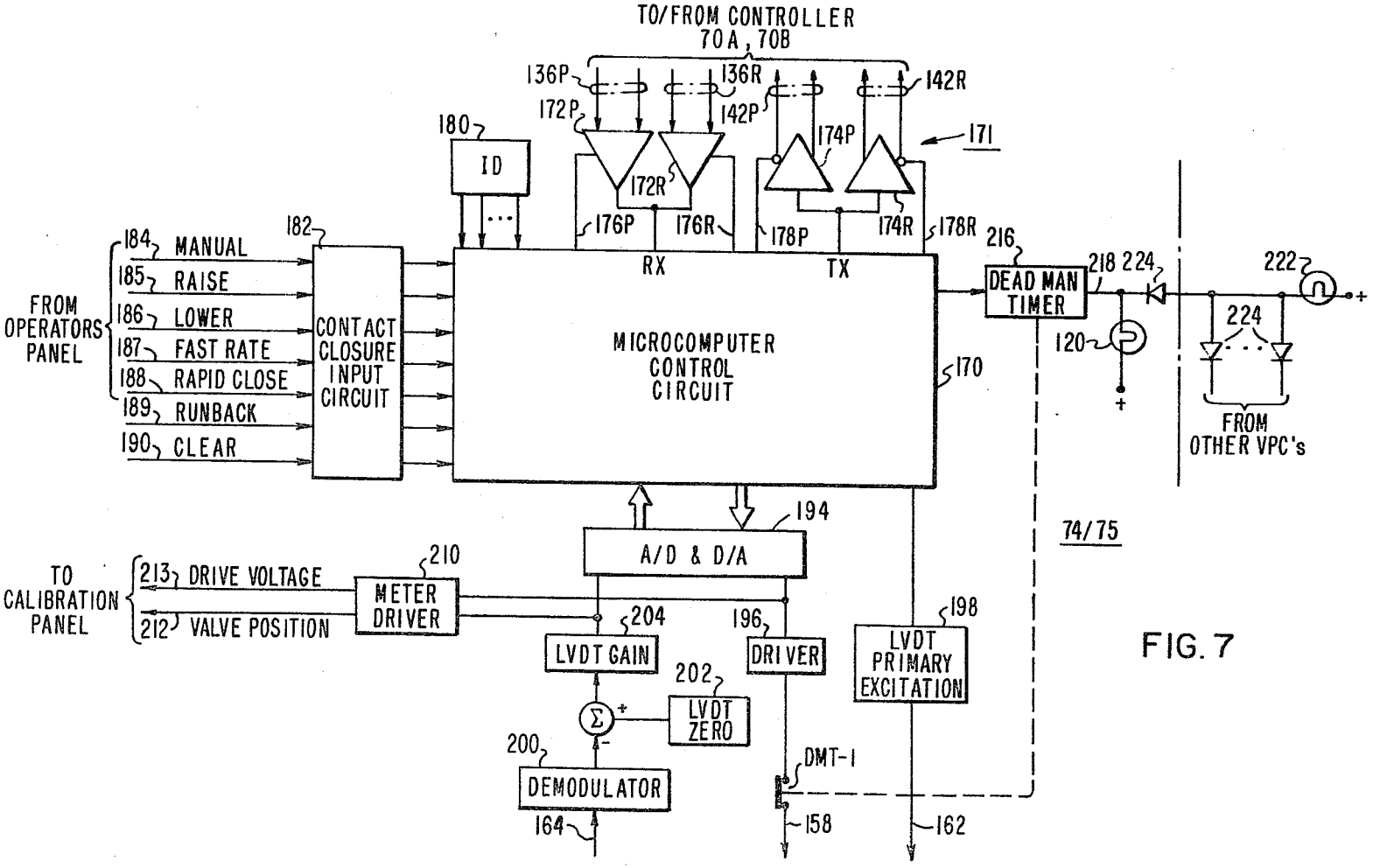
FIG. 7 is a block diagram illustrating a valve position control circuit of FIG. 2 in more detail.

With the exception of ID 180 all of the components of FIG. 7 thus far described may be placed on a single plug-in printed circuit card to facilitate replacement. An operator or technician merely need look at the plurality of identical cards to see which malfunction light has been turned on. Since this light is on a printed circuit card in a cabinet however, the operator will first have to be informed that a failure of one of the cards has occurred. To accomplish this there is provided a centralized indicating light 122 on the operator's panel, and having one terminal connected to a source of positive voltage and the other terminal connected commonly to the cathode electrodes of a plurality of diodes such as diode 224, each diode being located on a separate valve position control circuit card. Therefore when the signal on line 218 is removed, due to a malfunction, not only will indicating light 120 be energized but due to the circuit arrangement the centralized indicating light 122 on the operator's panel will also be energized.

MICROCOMPUTER CONTROL CIRCUIT

Figure 8:
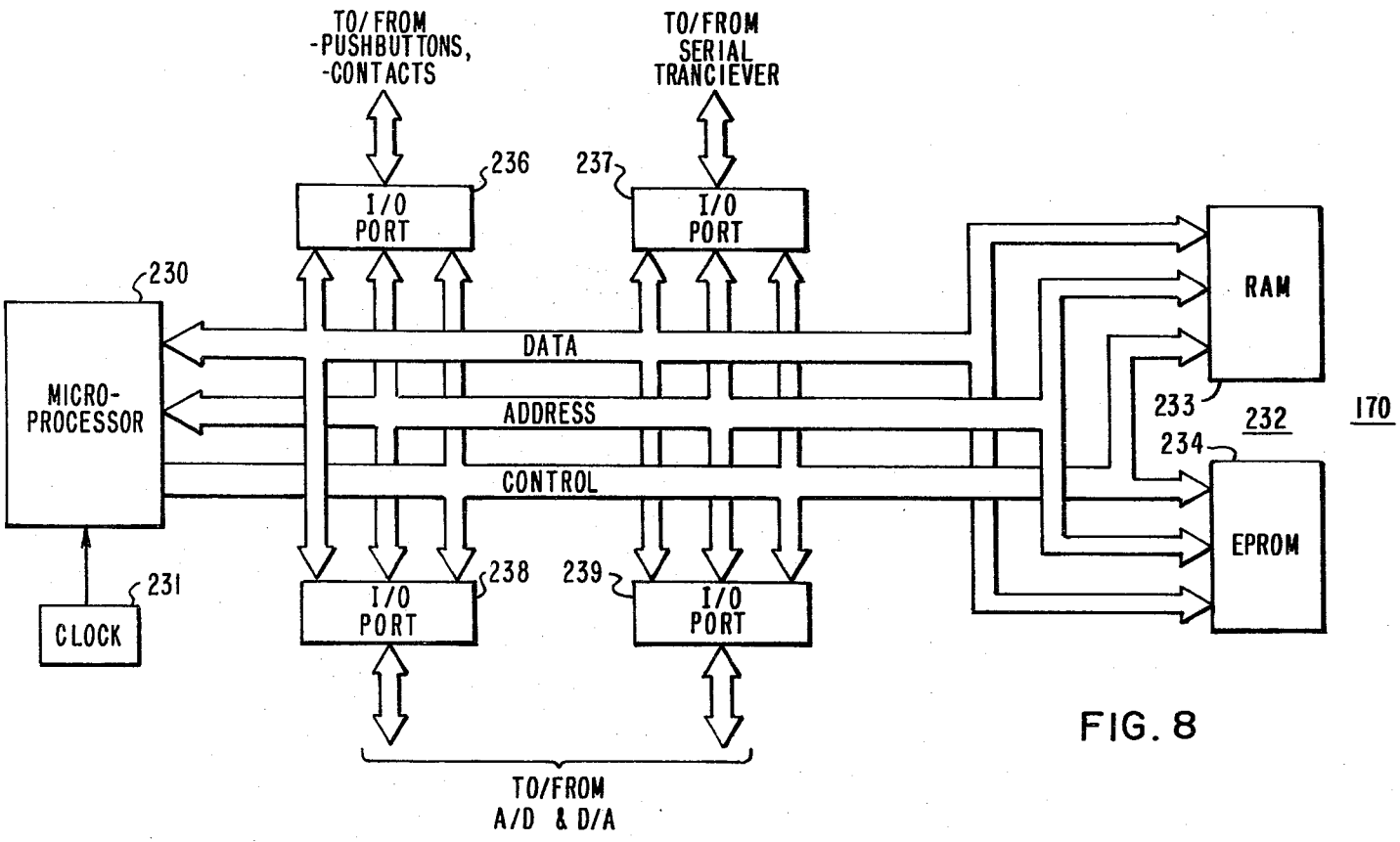
FIG. 8 is a block diagram illustrating the microcomputer control circuit of FIG. 7 in more detail.

A typical microcomputer control circuit 170 which may be utilized herein is further illustrated in FIG. 8. The circuit 170 includes a microprocessor 230 which receives various clock inputs from clock circuits 231. Memory means 232 is provided for storing digital information including data and operating instructions and is divided into two sections, namely a RAM 233 and an erasable PROM (EPROM) 234. The inputting and outputting of information is accomplished with the provision of a plurality of I/O ports 236 to 239. One of the ports, for example I/O ports 237 may be configured as a serial I/O port for transmission and reception of digital information by the transceiver arrangement 171 and digital data link. The other ports, or portions thereof, may be utilized for inputting analog information from, and outputting digital information to, the conversion circuits 194. Other inputs include the ID input as well as the contact and pushbutton inputs from lines 184–190. Other outputs include the kicking signal to the dead man timer 216 as well as control enabling signals for the transceiver arrangement 171. The microprocessor, memory and I/O ports are all in data, address and control communication by means of the provided data, address and control buses and such arrangement may be made up of standard well known commercially available circuits or may be purchased as a single microcomputer chip which itself includes the circuitry of FIG. 8.

A typical EPROM 234 will be of sufficient capacity so as to contain the various routines required in the operation of the valve position control circuit. By way of example such routines may include those necessary to establish proper communication between the valve position control circuit and the controllers 70A and 70B by operation of the transceiver arrangement 171. Typical initialization routines are included to set up certain registers, reset certain registers, and to set up the I/O ports telling them whether they are inputs or outputs. Also, the identification of the particular valve position control circuit is read into memory. Routines will also be included so as to enable the scanning of the various contact and pushbutton inputs periodically, for example every $\frac{1}{8}$th second, and to carry out the required response should one or more signals be present. Such response might be to update the control signal stored in memory at one or more predetermined rates, and to transmit the new calculated position signal back to the controllers 70A and 70B. Also included in the operating instructions will be the proportional plus integral algorithm for determining the valve drive signal. These various routines such as setting up, scanning, calculating etc. are widely utilized and known to those skilled in the art.

OPC CIRCUIT

Figure 9:
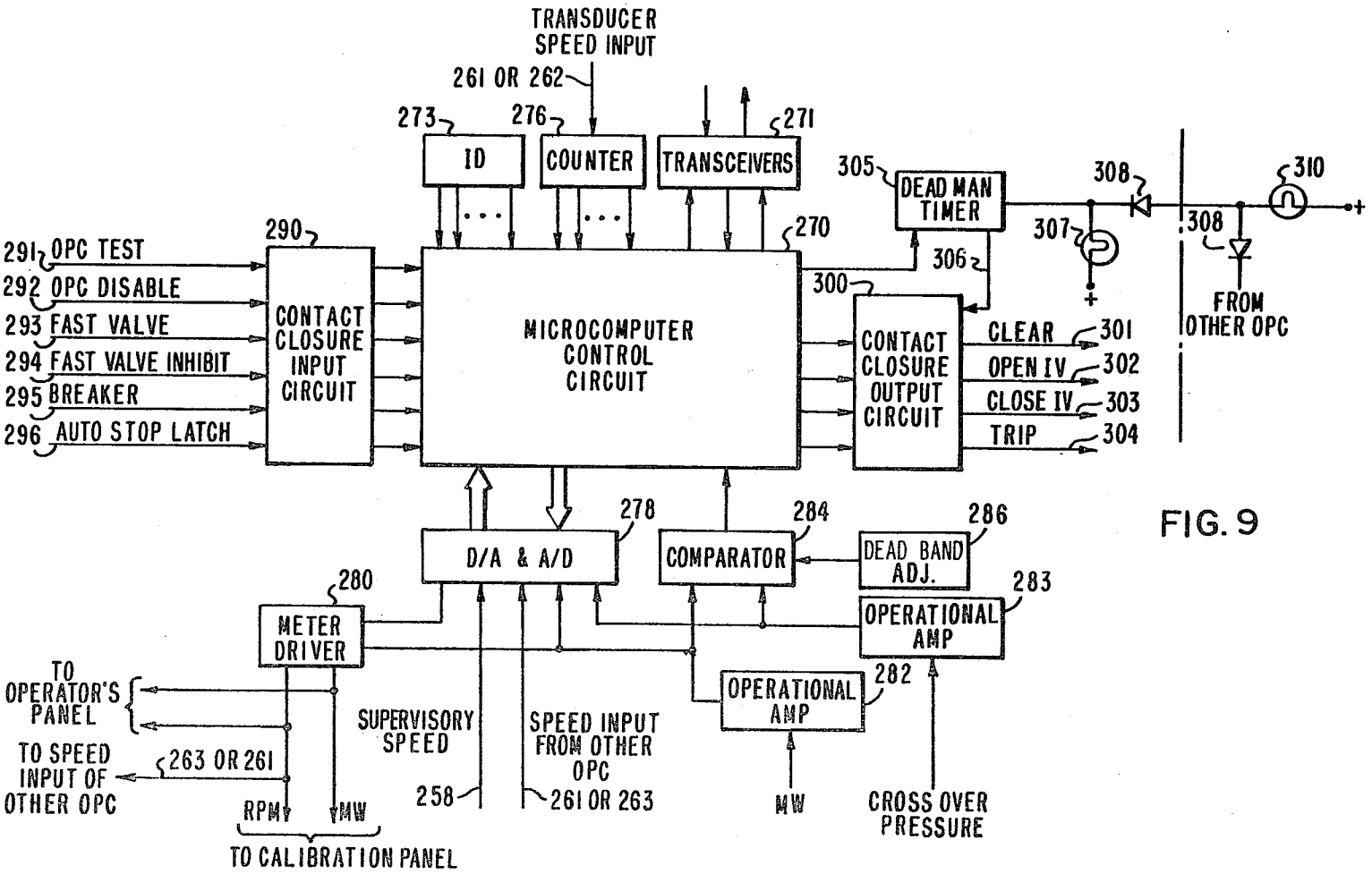
FIG. 9 is a block diagram of the OPC circuit of FIG. 2.

A typical OPC circuit 78 or 79 is illustrated in FIG. 9. Generally, and in the present case, the function of an OPC circuit is to provide an indication of turbine speed and to initiate the closing of certain valves should that speed exceed, by a predetermined amount such as 103%, the rated speed of the system and to initiate a trip signal indicating that the complete system should be shut down if the speed exceeds the rated speed by a second predetermined amount, such as 110%.

The OPC circuit 78 or 79 is further operable to provide fast valving functions. Basically, if the turbine load exceeds the generator output by a preset value, and if there are no transducer failures, the interceptor valves are closed and reopened after a certain time delay. This action is called fast valving, a technique that reduces turbine input power rapidly following recognition of a fault condition.

Figure 10:
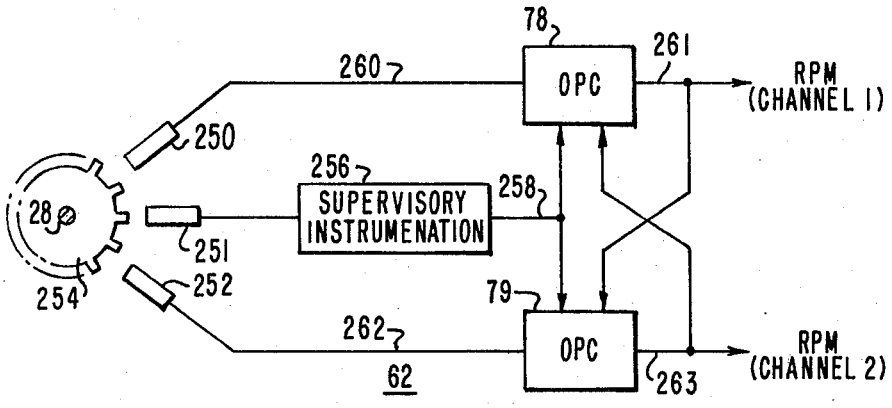
FIG. 10 is a block diagram illustrating the derivation of a plurality of speed signals.

The OPC circuit operates on certain speed inputs to derive a speed signal, RPM, for control purposes. With additional reference to FIG. 10, the speed inputs may be derived from a plurality of speed transducers 250, 251 and 252 in proximity to a notched wheel 254 attached to the turbine shaft 28. Transducers 250–252 are located at a predetermined distance from the wheel 254 so as to produce an approximate sinusoidal output waveform in response to movement of the wheel and wherein the frequency of the sinusoidal waveform is proportional to turbine speed.

A supervisory instrumentation processing circuit 256 is responsive to the output signal of transducer 251 to provide, on line 258, an analog signal indicative of turbine speed. Utilization of three speed transducers in conjunction with a supervisory instrumentation circuit is well known and described for example in U.S. Pat. Nos. 4,071,897 and 4,035,624.

In the present arrangement the output from transducer 250 is provided, on line 260 to OPC circuit 78 which in response thereto will provide an output RPM signal on line 261 constituting a channel 1 RPM output signal. Similarly the output from transducer 252 is provided, on line 262 to OPC 79 which in response thereto will provide an output RPM signal on line 263, constituting a channel 2 RPM output signal.

The OPC circuits are additionally operable to generate a presumed correct RPM signal for transmission to controllers 70A and 70B, for control purposes. In order to generate this presumed valid RPM signal, each OPC circuit receives three speed input signals, a first being the supervisory signal on line 258, the second being a respective speed input on line 260 or 262, and the third being the RPM signal from the other OPC. That is, the RPM signal on line 261 is provided to OPC circuit 79 and the RPM signal on line 263 is provided to OPC circuit 78.

Referring once again to FIG. 9, a typical OPC circuit includes a microcomputer control circuit 270 which may physically be identical to the microcomputer control circuit 170 of FIG. 8 and may even include some of the programs thereof in addition to its own programs for OPC and fast valving functions.

Transceiver arrangement 271, which may be identical to transceiver arrangement 171 of FIG. 7, is provided for the digital information linking between the OPC circuit and controllers 70A and 70B. Since, as illustrated in FIG. 2, the OPC circuits receive the same information as the valve position control circuits, an ID circuit 273 is provided so that selective addressing of the OPC circuit may be accomplished.

The substantially sinusoidal speed input signal from a speed transducer is converted to a squarewave which is counted by means of counter circuitry 276, the output of which will be operated upon by a computer program to derive an RPM signal. In order to derive an extremely precise RPM signal from the count, a well known digital filtering algorithm such as described in U.S. Pat. No. 4,099,237 may be used. The digital signal computed is operated upon by conversion circuits 278 where it is converted to an analog signal and fed to meter driver 280, the RPM output signal of which is provided to the operator's panel, to the calibration panel and to the speed input of the other OPC circuit.

In its fast valving function, the OPC circuit receives an MW signal from the power detector 60 as well as a crossover pressure signal from transducer 56 (FIG. 1). The signals are respectively amplified and conditioned by operational amplifiers 282 and 283 the output signals of which are provided to a comparator circuit 284. If the conditioned MW and crossover pressure signals differ by some predetermined amount as determined by the dead band adjustment 286 then comparator 284 will provide an output signal to the microcomputer control circuit 270 indicating that a fast valving action should be initiated.

The MW signal from operational amplifier 282 is provided to the meter driver 280 for display at the operator's panel and at the calibration panel. In addition, the signal is provided along with the crossover pressure signal from operational amplifier 283 to conversion circuits 278 where the signals are converted into a digital format for use by the microcomputer control circuit 270. The MW signal is placed into a storage location and then read out therefrom for transmission to the controllers 70A and 70B through the transceiver arrangement 271.

Contact closure input circuits 290 input to the microcomputer control circuit 270 a plurality of externally generated signals such as OPC TEST on line 291 OPC DISABLE on line 292, FAST VALVE on line 293, FAST VALVE INHIBIT on line 294, BREAKER on line 295 and AUTO STOP LATCH on line 296.

Contact closure output circuits 300 output a CLEAR signal on line 301, an OPEN INTERCEPTOR VALVE signal on line 302, a CLOSE INTERCEPTOR VALVE signal on line 303 and a TRIP signal on line 304.

In the speed control function a supervisory speed signal on line 258 and the speed input from the other OPC are converted to a digital signal and provided to the microcomputer control circuit where these two signals, in addition to the RPM signal derived from the output of counter circuits 276, are compared by a stored program to generate a presumed correct RPM signal which is transmitted to the controllers 70A and 70B through the transceiver arrangement 271. By means of another program the calculated RPM value is compared with a stored value representative of 103% of rated speed and if the calculated value exceeds this stored 103% value the computer will cause an output on the CLEAR line 301. With additional reference to FIG. 2, a clear signal from either OPC 78 or OPC 79 is applied, through gate circuit 81 to all of the governor valve position control circuits 75-l to 75-M. This CLEAR input signal appears on line 190 of FIG. 7. If the overspeed condition persists, the calculated speed value is subsequently compared with a stored value which is 110% of rated speed and if exceeded, the computer will cause an output on line 304 indicating a trip condition. This output may cause a shutdown of the turbine system or alternatively it may generate an audible and/or visual signal indicating to an operator that a trip situation exists.

In another computer operation, the output of comparator 284 is periodically examined to see if a signal exists, and if it does, fast valving action will be initiated by providing an output signal on line 303 to close the interceptor valves. Once the interceptor valves are closed they are reopened as soon as possible in order to reduce the pressure buildup in the reheater. The signal for reopening the interceptor valves is provided on line 302 generally within a fraction of a second after the close signal has been provided.

In the event of a failure of the microcomputer control circuit 270 the apparatus is operable to prevent any output signal from appearing on lines 301 to 304. This is accomplished with the provision of a dead man timer 305 which is operable, by a signal on line 306 to disable the contact closure output circuits 300.

In a manner similar to that described with respect to FIG. 7, the OPC circuit of FIG. 9 may be contained on a single printed circuit board which includes a failure indicating light 307 which will not be activated as long as the dead man timer 305 provides an output signal. The dead man timer 305 is additionally coupled through diode 308 to a centralized indicating light 310 connected to a source of positive potential and which will activate upon a failure indication.

The OPC TEST and DISABLE input signals on lines 291 and 292 emanate from the operator's control panel for testing purposes and the remainder of the input signals may emanate from user generated equipment. The FAST VALVE input may be used for test purposes whereas the FAST VALVE INHIBIT would prevent any closure of the interceptor valves even upon an MW and crossover pressure mismatch. A signal on the BREAKER line indicates that the generator circuit breakers are closed and a signal on the AUTO STOP LATCH line indicates that the turbine latch contacts are closed and the turbine is operational.

DIGITAL DATA LINKS

Figure 11:
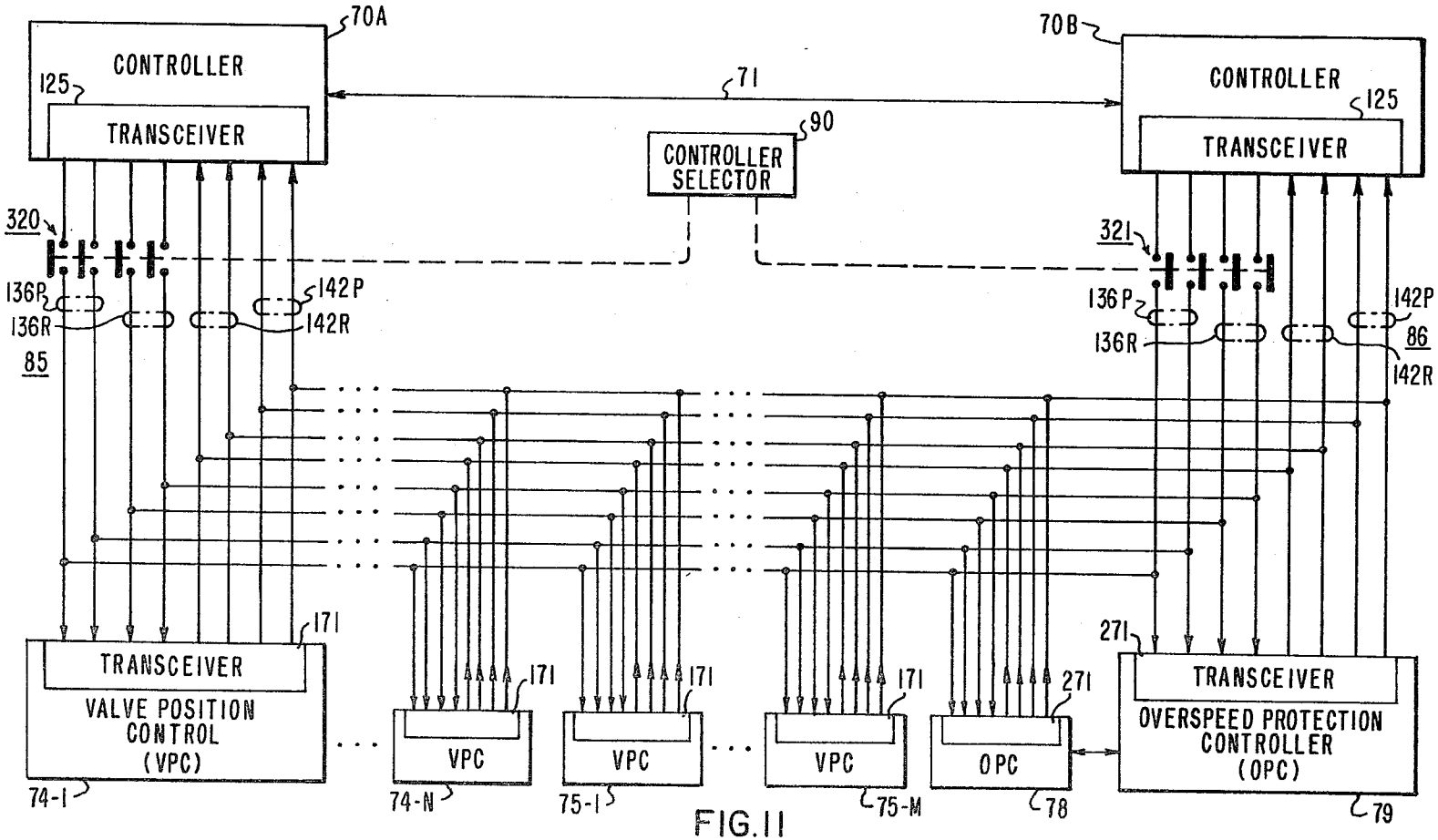
FIG. 11 is a block diagram illustrating the serial digital data link between the controllers and valve position control and OPC circuits.

FIG. 11 further illustrates the digital data links 85 and 86 which allow for serial data communication between the controllers 70A and 70B and the valve positions control and OPC circuits. In one embodiment, only one of the controllers is selected to generate control signals for use by selected valve position control and OPC circuits and to communicate to the non-chosen controller this information, along data link 71. Accordingly, one set of contacts 320 or 321 will be closed by the controller selector 90 for the downward data link. Data transmissions by individual ones of the valve position control and OPC circuits may however be provided to both controller 70A and 70B, simultaneously and hence no contacts are required in the upward data link.

Thus, FIG. 11 illustrates that the valve position control and OPC circuits are all bussed together in a party line configuration and the communication protocol is preferably in accordance with ANSI (American National Standard Institute) x 3.28—1976 standards with respect to identification, data flow and data security. The up and down balanced lines are fully redundant and in a preferred embodiment transmission from the selected controller occurs on both the primary and redundant lines while the particularly addressed valve position control or OPC circuit selects only one balanced line to receive. Normally, the primary bus is selected unless data is not received over a specified period of time in which case the redundant bus will be chosen.

OPERATOR'S PANEL

Figure 12:
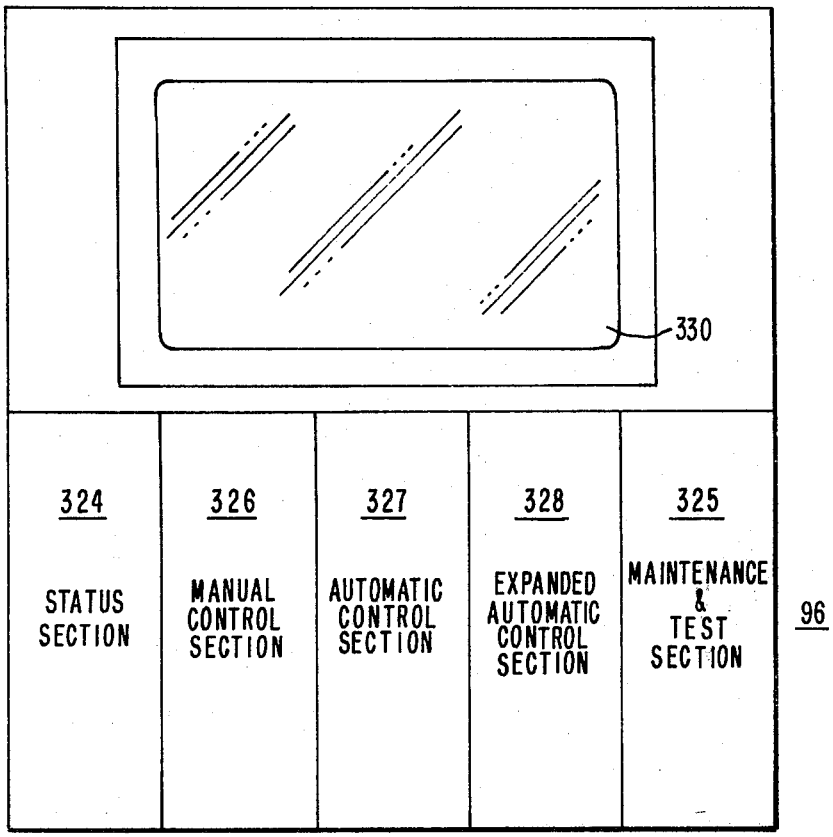
FIG. 12 illustrates the operator's panel with its various functions.

FIG. 12 is a further view of the operator's panel 96 which in the present case is greatly simplified for ease of operation and which is functionally arranged to provide for increased operational capabilities in a minimum of space.

The operator's panel is divided into a plurality of functional modules, or sections, which includes a status section 324, a maintenance and test section 325, and three levels of control as provided by the manual control section 326,, the automatic (auto) control section 327, and the expanded auto control section 328 which is operational in conjunction with a CRT 330 for various operator interactions with the controllers 70A and 70B.

Figure 13:
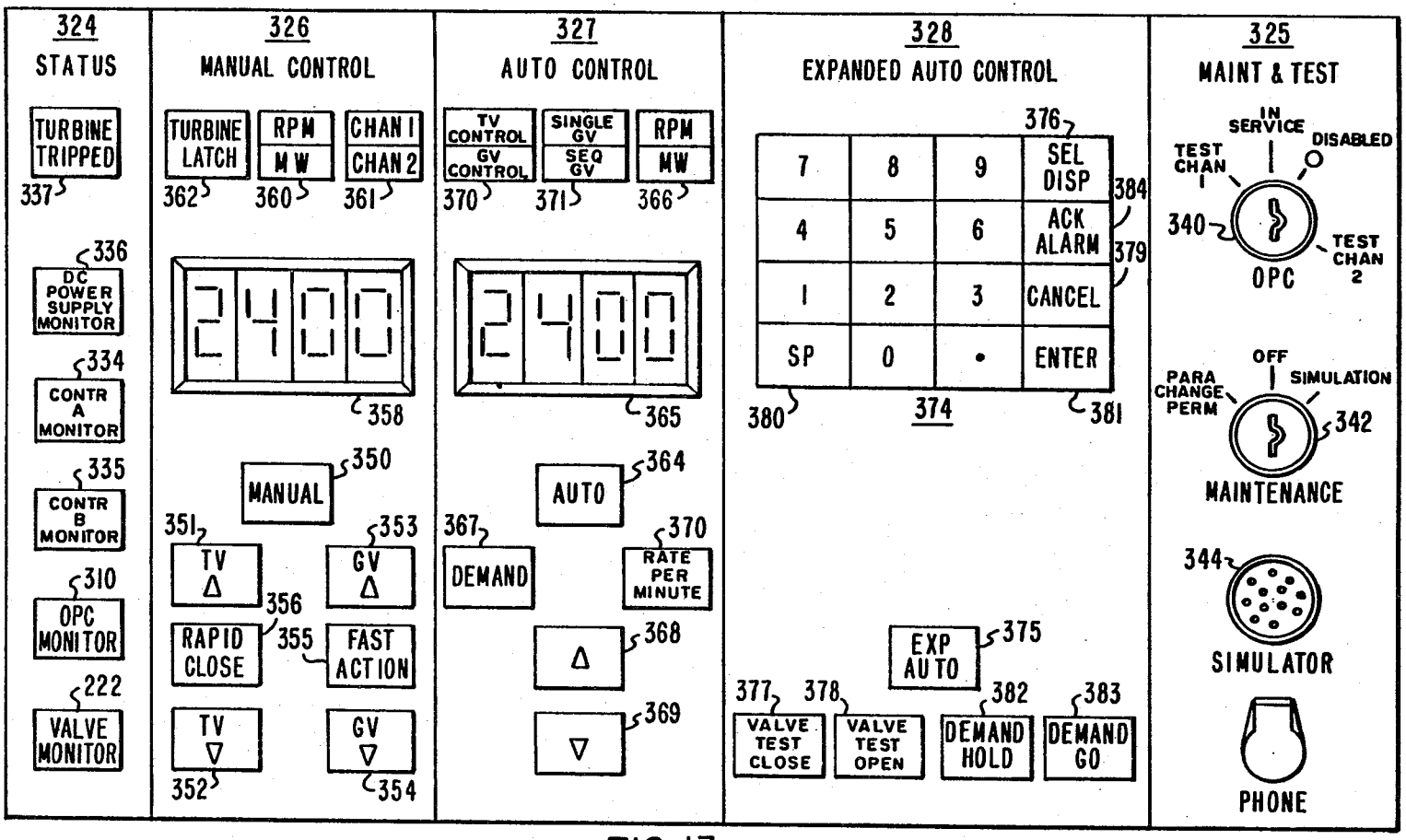
FIG. 13 is a more detailed view of the operator's panel control and displays.

Panel details of the functional sections 324 through 328 are further illustrated in FIG. 13. The status section 324 includes a plurality of indicating lights 222, 310 and 334 to 337. Indicating light 222, previously illustrated in FIG. 7 will activate if any one of the valve position control circuits should malfunction. Indicating light 310, previously illustrated in FIG. 9 will activate if either one of the two OPC circuits should malfunction. A similar malfunction arrangement may be provided for both controllers 70A and 70B and indicating lights 334 and 335 are provided for indicating respective failures of either one of the controllers. A plurality of DC power supplies is provided in order to power the various circuits, and indicating light 336 may be provided to indicate a failure of any one of the power supplies. The last indicating light of the status section is light 337 which will be activated if the turbine has been tripped. Preferably, the indicating lights are of the type which include a push to test feature so that the operating conditions of the light source may be determined.

Maintenance and test section 325 includes a key operated switch 340 for controlling certain OPC circuit operations. For the vertical position shown, the two OPC circuits will be in service. OPC 78 may be tested by rotating the key switch 340 to the position marked TEST CHAN 1, and OPC 79 may be tested by moving key switch to the position marked TEST CHAN 2. If neither OPC circuit is to be operational so as to allow for a mechanical overspeed test, key switch 40 may be moved to the position marked DISABLED. The OPC TEST and OPC DISABLE inputs to the OPC circuits are illustrated in FIG. 9 as the first two inputs on lines 291 and 292 respectively.

In the operation of the control system various parameters are utilized in the microcomputer memories, such parameters for example specifying reset times, alarm limits, gain of feedback loops, etc. Under normal operating conditions, once these parameters have been determined they cannot be changed by an operator. The maintenance and test section 325 however has provision for making these changes. This is accomplished in conjunction with the key operated switch 342 which may be moved to the position marked PARA CHANGE PERM, indicating that a parameter change is permissible.

When the control system is off-line, it may be put to use for operator training. In such instance, key switch 342 may be moved to the position marked SIMULATION, and various simulated system signals may be provided to the apparatus through a connector 344.

A manual backup control is provided by section 326 which includes a MANUAL pushbutton 350 which when depressed will cause the apparatus to enter into a manual backup mode of operation. When in the manual mode of operation, the throttle valves may be raised or lowered by means of pushbuttons 351 and 352, and the governor valves may be raised or lowered by means of pushbuttons 353 and 354. The raising and lowering of these valves will be at a predetermined rate such as 5% per minute. A predetermined faster rate such as $33\frac{1}{3}$% per minute may be achieved with the additional activation of FAST ACTION pushbutton 355. For emergency situations it may be desirable to rapidly close the valves, for example, at a rate of 200% per minute and RAPID CLOSE pushbutton 356 is utilized for this purpose. It is to be noted that, in the present arrangement, the signals provided by activation of pushbuttons 350 to 356 are entered directly into the valve position control circuits as illustrated in FIG. 7 without the intervention of any tracking or control circuitry which is utilized in prior art control systems.

The MW or RPM signals from the meter driver 280 of the OPC circuit in FIG. 9 may be selectively displayed on meter 358 of the manual control section 326. The meter may be of the multisegment light-emitting diode (LED) display type. Selective display of either the RPM or MW signal is determined by pushbutton 360 which is of the split-lens, back-lighted, alternate-action variety. Display of the MW and RPM signals from either one of the OPC circuits 78 or 79 is accomplished with the provision of pushbutton 361 also of the split-lens, back-lighted, alternate action variety.

A TURBINE LATCH pushbutton 362 is provided on the manual control section 326 to cause a contact closure to the turbine hydraulic system to initiate the building up of hydraulic working pressure.

AUTO pushbutton 364 of the auto control section 327 will place the apparatus into a first auto control mode wherein MW or RPM set points stored in the controller memory may be operator changed. If the circuit breakers 34 (FIG. 1) are open then the turbine is spinning with no electrical load and it is operative in a speed control mode. When in such mode, meter 365, which may be of the LED variety, will display the RPM set point. If the circuit breakers are closed, then the system is operative in a load control mode and the MW set point will be displayed by meter 365. A split-lens indicating light 366 will indicate which of the two set points is being displayed.

To change the set point the operator may activate DEMAND pushbutton 367 in conjunction with either pushbutton 368 or 369, the former being utilized to increase the set point value and the latter to decrease it. The rate at which the set point is changed, that is, RPM/minute or MW/minute may be changed by operation of RATE PER MINUTE pushbutton 370 in conjunction with either pushbutton 368 or 369.

Auto control section 327 includes two other split-lens back-lighted pushbuttons one of which, pushbutton 370, is for placing the apparatus into a throttle valve control or governor valve control mode of operation. Generally, on start up and up to approximately two thirds of rated speed, the operator will select the throttle valve control and once two thirds of rated speed, or any other predetermined proportion of rate speed is achieved, the operator will switch to a governor valve control mode of operation. The other pushbutton 371, allows the operator to place the apparatus into a single governor valve mode of operation equivalent to a full arc admission, or a sequential governor mode of operation equivalent to a partial arc admission.

The capabilities of the automatic control mode are significantly increased with the provision of keyboard 374 of the expanded auto control section 328 with the keyboard, in conjunction with the CRT 330, allowing for entry and display of numerical set points, displays of feedback loops and limiter status and conversational dialogue for operator interactions. This expanded auto control mode of operation is entered into by activation of EXP AUTO pushbutton 375.

By means of SEL DISP pushbutton 376, the operator can place on the CRT a list of various features which may be selected by number. By way of illustration only, these features may include the setting of various parameters including demands such as MW and RPM, rates such as MW/minute and RPM/minute and various limits such as valve position, high and low load limits, remote set point throttle pressure limits, programmed set point throttle pressure limits, to name a few.

The format may include the selection of various controls such as automatic synchronization, a master computer control, the selection of various feedbacks, such as throttle pressure correction, impulse pressure, MW, RPM, the selection of various limiters and whether they should be in or out of the control. Various data may be displayed at will as well as individual valve positions such as in the form of a bar graph.

One of the control features may be the provision to change certain parameters which are normally not changeable but with the activation of key switch 342 to the parameter change permissive position will allow such change.

As a safety feature, one of the selections may be for a valve test. In conjunction with this selection of a valve test, VALVE TEST CLOSE pushbutton 377 may be activated to close the valve. In one arrangement, if the selected valve is a throttle valve, reheat stop or interceptor valve, the selected valve may reopen when the operator releases the VALVE TEST CLOSE pushbutton 377. If on the other hand a governor valve is tested and VALVE TEST CLOSE pushbutton 377 is activated, the governor valve will remain in the closed position until the VALVE TEST OPEN pushbutton 378 is activated to return the valve to its pre-test position.

In addition to numerical entries, the keyboard 374 includes a plurality of buttons for operator interaction. Thus if a certain display is chosen, the operator may cancel it and choose a new one by activation of the CANCEL pushbutton 379. This pushbutton may also be used to cancel operator entered data.

In conjunction with the entry of numerical data, SP pushbutton 380 may be utilized to verify what the operator has entered. That is, once a numerical entry has been made, and the operator activates pushbutton 380, the CRT display will indicate the number that the operator has chosen. Thereafter the operator may activate the ENTER pushbutton 381 to cause the data to be entered into the system. This pushbutton may also be utilized for confirmation of questions generated on the CRT during operation of the expanded auto control mode.

DEMAND HOLD pushbutton 382 and DEMAND GO pushbutton 383 are functional at all times when in the expanded auto control mode. They are used to halt the moving of the demand set point (382) and to continue the moving (383) after a halt.

The operation of the expanded auto control section 328 may include a provision for flashing various warnings or alarms on the CRT so that the operator can take appropriate actions. These alarms are acknowledged by activation of pushbutton 384 by the operator which may then cause a cancellation of the flashing alarm condition.

Thus it is seen that the operator's panel provides three different levels of operations, namely, a manual control, an auto control and an expanded auto control. These three separate functions are performed by the three different panel sections 326, 327 and 328 each section containing associated pushbutton control elements and some form of a display. With this arrangement any one of the panel sections may be serviced without interrupting essential control and this includes the servicing of either one of the auto control sections since one auto control mode may be used as a backup for the other during such servicing operations or in the event of a failure.

CALIBRATION PANEL

Figure 14:
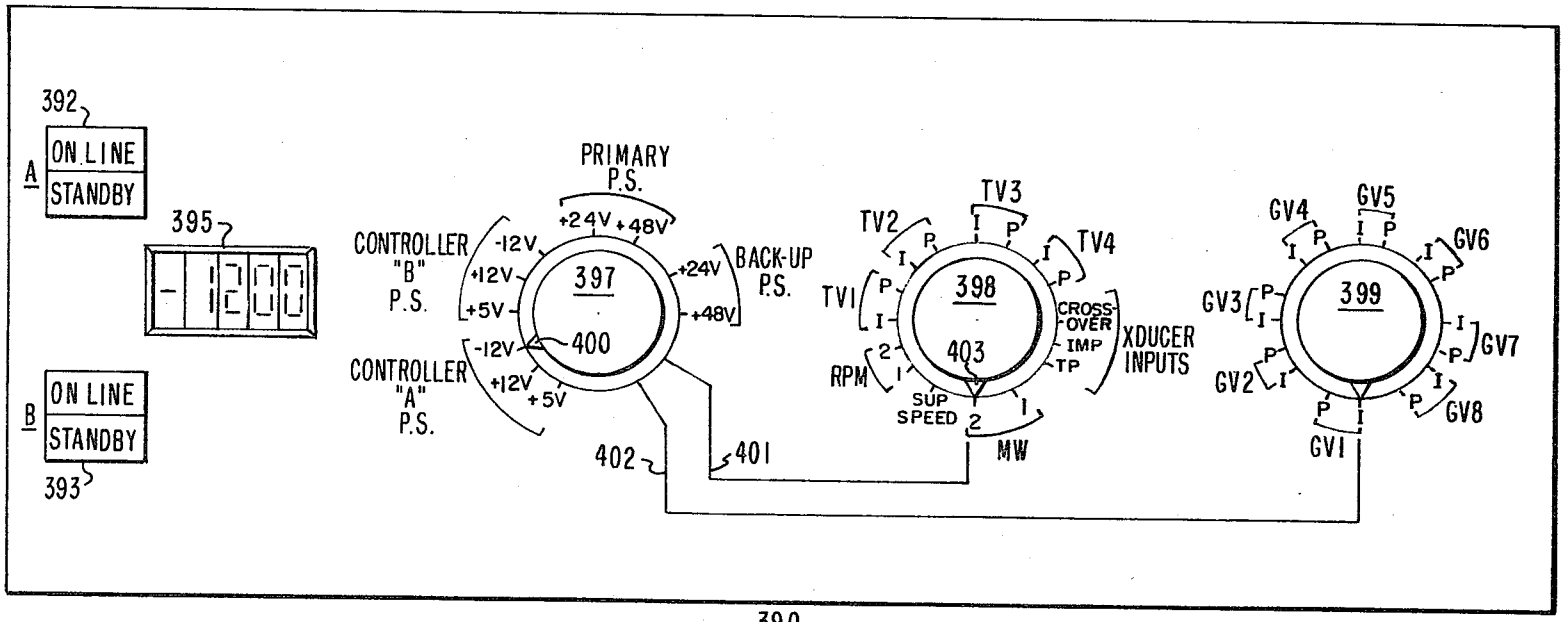
FIG. 14 illustrates a calibration panel utilized herein.

During operation of the turbine control system it may be desirable to run a check on various voltages throughout the system. For this purpose a calibration panel 390 illustrated in FIG. 14 may be provided. The voltage check may be carried out while controller 70A is on-line and 70B on standby or vice versa. Accordingly, a split-lens back-lighted alternate-action pushbutton 392 is provided for placing controller 70A on-line whereas pushbutton 393 is provided for placing controller 70B on-line.

To provide the checking function in a minimal of space, the calibration panel includes a single meter display 395 together with a plurality of display selector dials 397, 398, and 399. With respect to dial 397, each controller may have a +5 volt, +12 volt and a −12 volt power supply. Any one of these three voltages for either controller 70A or controller 70B may be displayed on the meter 395 by appropriate movement of pointer 400 to the desired parameter display.

The valve position control circuits as well as the various portions of the operator's panel and certain contact inputs require +24 and +48 volt supplies. These power supplies are also provided with a back-up and pointer 400 may be moved to select either the +24 or 30 48 volt supply in the primary or backup power supply system for display on the meter 395.

If pointer 400 is moved to a position opposite line 401 on the calibration panel, then those parameters associated with dial 398 may be displayed and when pointer 400 is moved to a position opposite line 402 then those parameters associated with dial 399 may be selected for display.

Assuming that the turbine system has four throttle valves, then pointer 403 of dial 398 may be moved to select for display either the drive voltage (I) or the valve position (P) of a selected throttle valve. These voltages are derived from the meter driver 210 of FIG. 7.

Various voltages associated with the OPC circuit of FIG. 9 may also be displayed and this includes the RPM and MW signals from channels 1 and 2 (from meter driver 280 of FIG. 9) as well as the supervisory speed indication. The remaining items associated with dial 398 relate to certain transducer inputs including the throttle pressure TP, impulse pressure IMP, and cross-over pressure.

In a similar manner dial 399 relates to the display of drive voltages and positions of eight governor valves, these voltages being derived from meter driver 210 of FIG. 7.

CONTROLLER SELECTOR

Figure 15:
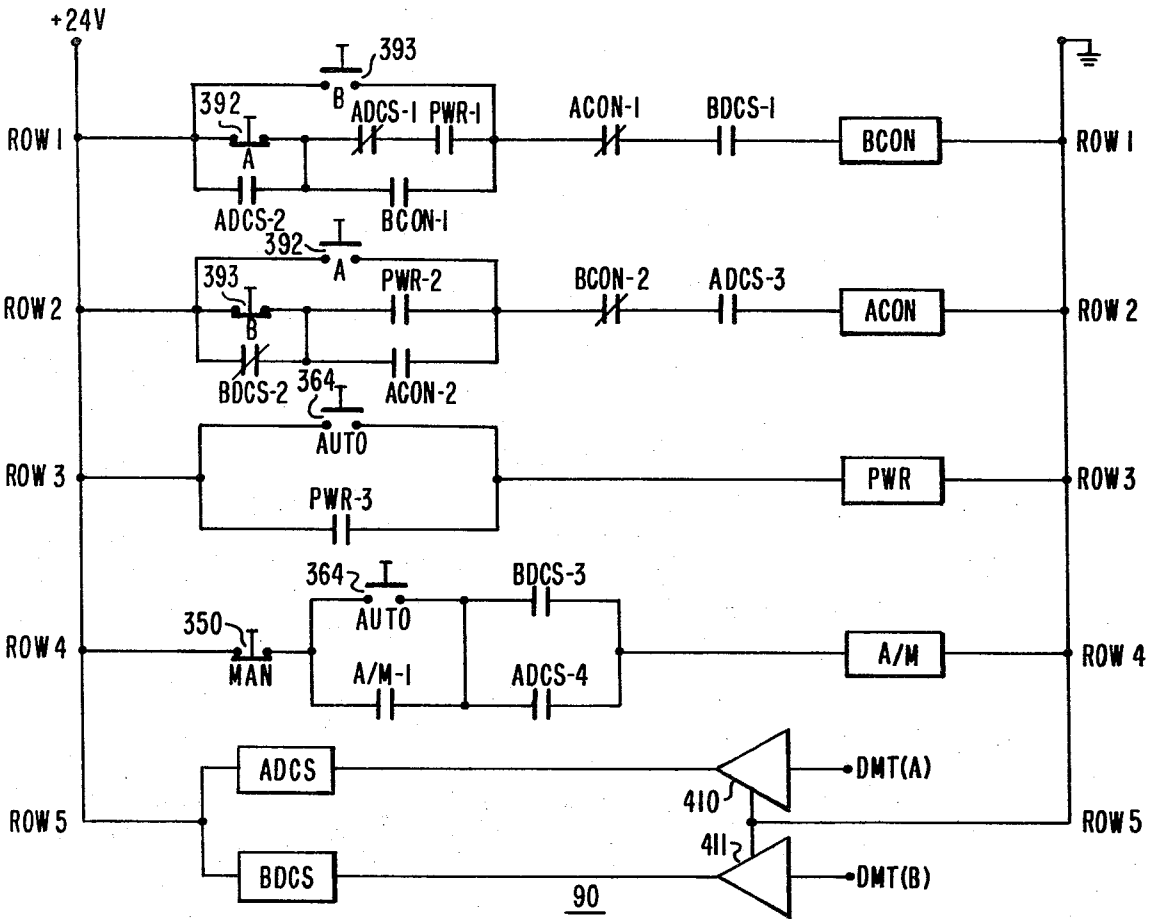
FIG. 15 is a circuit diagram illustrating the controller select of FIG. 2 in more detail.

The function of controller selector 90 may be implemented with a plurality of relay circuits such as illustrated in FIG. 15. For purposes of explanation the circuitry has been divided into a plurality of rows, each including at least a relay coil and each being connected between a positive line (+24 volts) and a ground line.

Row 1 includes a B control relay, BCON, row 2 an A control relay, ACON, row 3 a power relay, PWR, row 4 an automatic/manual relay, A/M, and row 5 an A dead computer switch, ADCS, and a B dead computer switch, BDCS. These latter relays are energized by means of respective drivers 410 and 411, with driver 410 being operable to energize relay ADCS in response to an input dead man timer signal (see FIG. 4) of controller 70A and with driver 411 being operable to energize the BDCS relay in response to an input dead man timer signal from controller 70B.

The first 4 rows include various contacts associated with the relays as well as pushbuttons previously described. In FIG. 15 a contact has been given the same letter designation as its associated relay, together with a numerical designation. Thus the BCON relay has an associated normally open contact BCON-1 in row 1 and a normally closed contact BCON-2 in row 2. Similarly, the ACON relay has a normally open contact ACON-2 in row 2 and a normally closed contact ACON-1 in row 1. Row 1 further includes a normally open BDCS-1 contact as well as a parallel arrangement of various pushbutton and contacts such as the A and B pushbuttons 392 and 393 previously described with respect to the calibration panel of FIG. 14. In line with the a pushbutton is the normally closed contact ADCS-1 and the normally open contact PWR-1. The other two contacts in the row are normally open contact ADCS-2 and the normally open contact BCON-1.

Row 2 is somewhat similar to row 1 with one less contact. Row 2 includes the normally open contact ADCS-3 and a parallel arrangement including the A and B pushbuttons 392 and 393 as well as contact PWR-2 and normally closed contact BDCS-2 and normally open contact ACON-2.

In row 3 the auto pushbutton 364 is on the operator's panel described in FIG. 13 and when it is pushed, relay PWR will be latched in with the closure of the contact PWR-3 in row 3.

In addition to the auto pushbutton 364, row 4 includes the manual pushbutton 350 as well as the plurality of contacts BDCS-3, A/M-1 and ADCS-4.

Figure 16A:
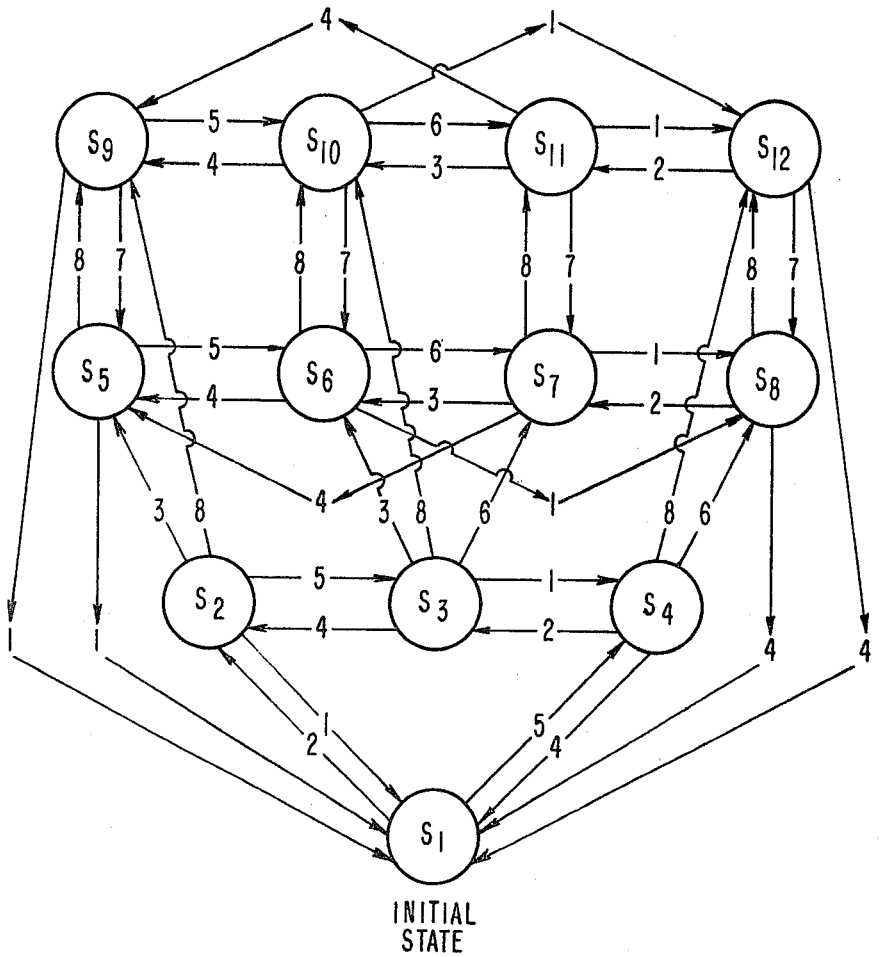
FIG. 16A is a bubble diagram defining various states of operation of the controllers.

Operation of the circuitry of FIG. 15 will be described with additional reference to FIGS. 16A through 16C wherein 16A is a bubble diagram representing the various controller states and transition between states, FIG. 16B is a table defining the various states and FIG. 16C is a table defining the various transfer activations to transfer between states.

With reference to FIG. 16A, on initial power-up or on a restart, the controllers are in initial state $S_1$. While in state $S_1$, and as seen in FIG. 16B, both the A controller (70A) and B controller (70B) are unavailable for control and the control is governed manually. During the course of start-up controllers 70A and 70B each provide a dead man timer signal such that relays ADCS and BDCS are energized. This is equivalent to transfer activations 2 and 5 of FIG. 16C. Depending upon which relay picks up first, a transition will take place from $S_1$ to either $S_2$ along transition path 2 or from $S_1$ to $S_4$ along transition path 5, the path number corresponding to the transfer activation of FIG. 16C. While in state $S_2$ or $S_4$ and with the ADCS and BDCS relay still energized, a transfer will be made to state $S_3$, where as seen in FIG. 16B both controllers are in a standby mode and control is still manual.

Three possible upward transitions are available from state $S_3$ to either state $S_6$ along path 3, to state $S_7$ along path 6 or to state $S_{10}$ along path 8. If the A select pushbutton is depressed (transfer activation number 3) the ACON relay of row 2 will energize opening the ACON-1 contact in row 1 and closing the ACON-2 contact in row 2. After pushbutton A is released the ACON relay is latched by way of the path from the positive voltage line through pushbutton 393 contact ACON-2, contact BCON-2 and contact ADCS-3. In state $S_6$ as seen in FIG. 16B the A controller will then be on-line and the B controller will be on standby with the control mode still being manual. The control mode will remain in manual until such time as the auto pushbutton 394 is depressed.

Had the B select pushbutton been depressed rather than the A select pushbutton the transition would have been from state $S_3$ to $S_7$ with the BCON relay of row 1 being energized.

Activation of the ACON relay may close contacts 320 and activation of the BCON relay may close contacts 321 both illustrated in FIG. 11 so that only the on-line one of the two controllers will transmit information down to the valve position control and OPC circuit cards.

While in state $S_6$ or $S_7$ transitions may be made laterally to states $S_5$ or $S_8$ upon the occurrence of certain conditions as designated by the path number and as listed in FIG. 16C. For example, if in state $S_6$ the BDCS relay becomes deenergized, operation will switch to state $S_5$ where the A controller is on-line but the B controller is unavailable. If while in state $S_6$ the B select pushbutton is depressed operation will switch to state $S_7$ where the A controller switches to standby and the B controller comes on-line. Similarly, if in state $S_7$ the ADCS relay becomes deenergized operation will switch to state $S_8$ where the A controller becomes unavailable and the B controller comes on-line.

During the manual control mode, the A/M relay is deenergized, this deenergization representing that the system is in the manual mode of operation. Although not illustrated in FIG. 15 the A/M relay may control a light in the manual pushbutton, may send a signal to the controllers indicating a manual mode of operation, and may also serve as the MANUAL input to the valve position control circuit previously described. If the A/M relay is energized, it represents operation in the auto mode. When the auto pushbutton 364 is depressed, it will cause energization of the A/M relay in row 4 which locks in by virtue of the path through the manual pushbutton 350, the A/M-1 contact and the ADCS-4 and BDCS-3 contacts. Similarly, in row 3, the PWR relay will be energized and latched in through the PWR-3 contact. Activation of the PWR relay also closes the PWR-1 contact in row 1 and PWR-2 contact in row 2. The transfer activation number 8 causes the state to go from $S_3$ to $S_{10}$ where in FIG. 16B it is seen that the A controller is on line and the B controller is in standby with the control mode being automatic.

It is to be noted that the relay and contact arrangement is such that when the auto pushbutton is depressed it will force a preferred one of the controllers into the on line condition. This is accomplished with the provision of an extra ACDS contact in row 1, that is, the normally closed ADCS-1 contact. As long as the ACDS and BDCS relays are energized, the ADCS-1 contact remains open. In state $S_3$ neither controller is on-line and accordingly the ACON-1 contact in row 1 is closed as is the BCON-2 contact in row 2. When the PWR-2 contact is closed in row 2 a completed path is afforded the ACON relay so as to energize, whereas the ADCS-1 contact in row 1 would be open thereby preventing the BCON relay from energizing. If however at this point it is desired that the B controller take over, the B pushbutton 393 may be depressed causing the ACON relay to lose power but allowing the BCON relay to be energized. This latter action is represented by the transition path from state $S_{10}$ to $S_{11}$.

The upper level states $S_9$ to $S_{12}$ represent various operations in the automatic mode. An operation may be switched back down to the level containing states $S_5$ through $S_8$ by activation of the manual pushbutton.

If in state $S_9$ or $S_{12}$ where one controller is on-line and the other unavailable, and if the on-line computer fails to provide a dead man timer signal then the transition will be along path 1 or 4 back to the initial state $S_1$.

Various other transfers from state to state are illustrated in FIG. 16A and by correlating the path number with the transfer activation of FIG. 16, resulting controller condition and control mode may be examined in FIG. 16B.

SYSTEM HOUSING

Figure 17:
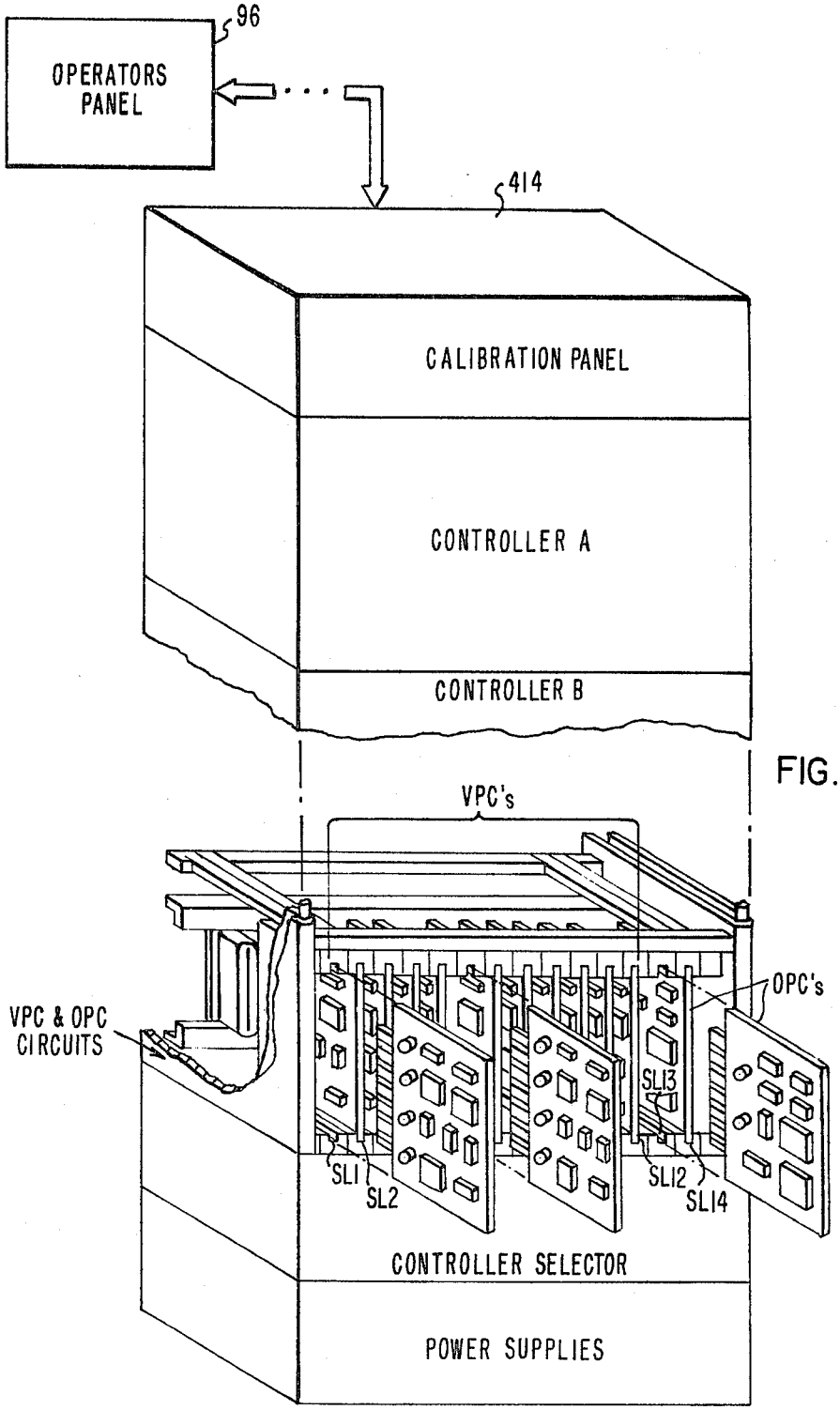
FIG. 17 is a view, with a portion broken away, of the physical arrangement of various circuits described herein.

The modular architecture in conjunction with the standardized printed circuit boards and distributed use of microprocessors allows the control apparatus to be housed in a single relatively small cabinet 414, as illustrated in FIG. 17 and space requirements in the control room are thus kept to a minimum. The various different circuits described herein are designated on the front of the cabinet and the arrangement greatly facilitates the servicing of these various subsystems.

A portion of the cabinet is broken away to illustrate some circuit cards in the valve position control and OPC circuit section. The circuit cards are placed into slot locations SL1, SL2, SL3 . . . with N of the slot locations being particularly designated for throttle valve position control circuits, M of the slots for governor valve position control circuits and 2 of the slots for the OPC circuits. Fourteen slot locations are illustrated by way of example. Therefore all of the valve position control circuits can be identical, with just their slot position determining the particular throttle valve or governor valve control function. Additionally, each slot location may be wired to have a particular identification such that when a printed circuit card is placed into that slot location it will assume that designated ID. If the valve position control or OPC circuit fails it is an easy matter of removing the failed card and inserting a new one taken from a backup supply of identical valve position control circuits (or OPC circuits). The reduction in the different types of cards with the present invention reduces the technical training requirement for maintenance personnel and in addition reduces the number of different spare parts required.

SYSTEM EXPANSION

In the description of the basic controller circuit 70 of FIG. 3, transceiver circuit arrangement 150 was included for interaction with other computer systems. The expansion of the present arrangement for communication with higher order computers is illustrated in FIG. 18.

Figure 18:
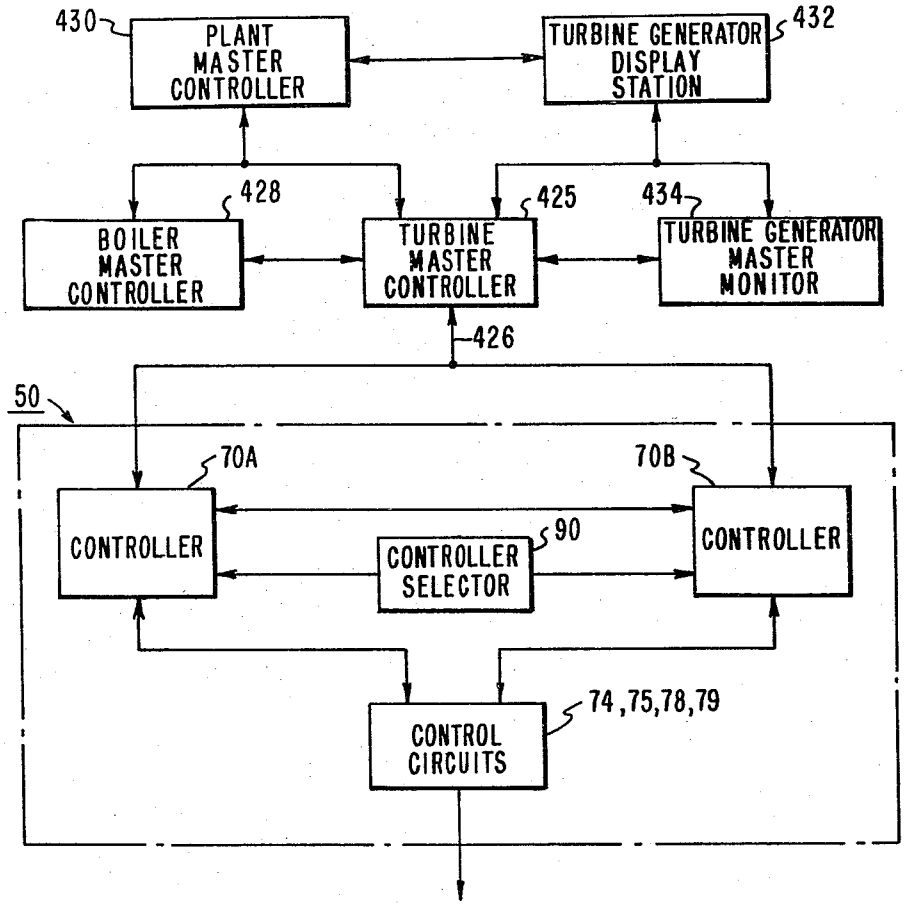
FIG. 18 is a block diagram illustrating the expansion capabilities of the turbine control system.

In FIG. 18 the present turbine control system 50 is communicative with a turbine master controller 425 by means of a serial data link 426. This turbine master controller 425 provides a means to coordinate with a plurality of other controllers which may be provided such as a boiler master controller 428 for controlling boiler operations, and a plant master controller 430 for coordinating various equipment to run the plant more efficiently.

A turbine generator display station 432 may be provided for graphic presentation in color, of various parameters, while the turbine generator master monitor 434 may be provided for running various diagnostic routines.

By means of the data link 426 the turbine master controller 425 may directly input information to controllers 70A and 70B for example with respect to various set points based on various turbine stress conditions or boiler capabilities. The turbine master controller may also request data from the controllers 70A and 70B relative to operating conditions, valve positions, MW readings, etc.

We claim:

1. A control system for a steam turbine operative to drive an electric generator and having a plurality of steam admission valves which are controllable in position to determine the operating level of the turbine, comprising:

(A) a controller including programmable digital computer means operable to receive and store input target set point signals and being responsive to said signals to generate a plurality of digital valve control signals;

(B) each said steam admission valve including a valve actuation circuit operable, in response to a valve position control signal, to position the valve so as to control its degree of opening;

(C) position detection means coupled to each said valve to provide respective feedback signals indicative of valve position;

(D) a plurality of valve position control circuits each including programmable digital computer means operable to receive and store a respective one of said digital valve control signals as well as a respective one of said feedback signals and being responsive to said digital valve control and feedback signals to generate a respective one of said valve position control signals; and (E) said programmable digital computer means of said valve position control circuit being additionally operable to transmit selected stored digital information back to said controller.

2. Apparatus according to claim 1 which includes:

(A) a second controller including programmable digital computer means operable, when selected and in response to input target set point signals to generate a plurality of digital valve control signals;

(B) said second controller being in digital data communication with said plurality of valve position control circuits.

3. Apparatus according to claim 2 wherein:

(A) both of said controllers are operable to receive digital data signals from said plurality of valve position control circuits but only a selected one of said controllers at a time is operable to transmit said digital valve control signals to said plurality of valve position control circuits.

4. Apparatus according to claim 3 wherein:

(A) said selected controller is additionally operable to transmit said digital valve control signals to the non-selected controller.

5. Apparatus according to claim 3 which includes:

(A) a controller selector operative under predetermined conditions to place one of said controllers in an on-line state, and the other in a standby state;

(B) said controller selector is operable to determine which of said controllers is operable to transmit said data signals.

6. Apparatus according to claim 2 which includes:

(A) a controller selector operative under predetermined conditions to place one of said controllers in an on-line state, and the other in a standby state.

7. Apparatus according to claim 6 which includes:

(A) an operator's panel including a manual control section and at least an automatic control section;

(B) said automatic control section including operator activated means for placing said apparatus into an automatic control mode;

(C) said controller selector being responsive to said operator activated means to preferentially place the first of said controllers on-line.

8. Apparatus according to claim 1 which includes:

(A) means for providing a turbine speed indicative signal; and (B) an overspeed protection controller circuit including programmable digital computer means responsive to said turbine speed indicative signal and operable to provide a first presumed valid RPM turbine speed signal.

9. Apparatus according to claim 8 which includes:

(A) at least a second overspeed protection controller circuit including programmable digital computer means responsive to said turbine speed indicative signal and operable to provide a second presumed valid RPM turbine speed signal.

10. Apparatus according to claim 9 which includes:

(A) a second controller including programmable digital computer means operable, when selected and in response to input target set point signals to generate a plurality of digital valve control signals;

(B) said second controller being in digital data communication with said plurality of valve position control circuits and said overspeed protection controller circuits.

11. Apparatus according to claim 10 wherein:

(A) both of said controllers are operable to receive digital data signals from said plurality of valve position control circuits and said overspeed protection control circuits but only a selected one of said controllers at a time is operable to transmit digital data signals to said plurality of valve position control circuits and said overspeed protection control circuits.

12. Apparatus according to claim 9 which includes:

(A) speed sensing means for deriving three independent signals each indicative of turbine speed;

(B) the first of said overspeed protection control circuits being responsive to one of said derived signals for generating a first RPM speed signal;
(C) the second of said overspeed protection control circuits being responsive to another of said derived signals for generating a second RPM speed signal;
(D) the first of said overspeed protection control circuits additionally being responsive to the third of said derived signals and said second RPM signal for deriving a first valid RPM signal;
(E) the second of said overspeed protection control circuits additionally being responsive to the third of said derived signals and said first RPM signal for deriving a second valid RPM signal.

13. Apparatus according to claim 9 wherein:
(A) each said overspeed protection controller circuit is operable to compare said presumed valid RPM turbine speed signal with at least one predetermined stored value indicative of an overspeed condition and provide an output signal indicative of said overspeed condition, if said stored value is exceeded; and which includes
(B) means for providing said output signal of both said overspeed protection controller circuits to selected ones of said valve position control circuits to initiate closing of the valves controlled by them.

14. Apparatus according to claim 9 which includes:
(A) means for deactivating a particular overspeed protection control circuit from its control function in the event of a malfunction in that overspeed protection control circuit.

15. Apparatus according to claim 8 wherein:
(A) said overspeed protection controller circuit is operable to compare said presumed valid RPM turbine speed signal with at least one predetermined stored value indicative of an overspeed condition and provide an output signal indicative of said overspeed condition, if said stored value is exceeded; and which includes
(B) means for providing said output signal indicative of said overspeed condition to selected ones of said valve position control circuit to initiate closing of the valves controlled by them.

16. Apparatus according to claim 15 wherein:
(A) said steam admission valves include throttle valves and governor valves;
(B) said output signal is provided only to the valve position control circuits controlling said governor valves.

17. Apparatus according to claim 8 which includes:
(A) a plurality of field termination circuits; and wherein
(B) said valve position control and overspeed protection controller circuits are operable to receive input signals indicative of predetermined steam turbine/generator parameters; and wherein
(C) said input signals are first provided to said field termination circuits to provide for signal conditioning and surge voltage protection.

18. Apparatus according to claim 17 wherein:
(A) said valve position control and overspeed protection controller circuits are operable to provide output control signals; and wherein
(B) selected output control signals are provided to said field termination circuits.

19. Apparatus according to claim 1 which includes:
(A) means for deactivating a particular valve position control circuit from its control function in the event of a malfunction in that valve position control circuit.

20. Apparatus according to claim 1 wherein:
(A) digital data signals are transmitted from said controller to said valve position control circuit and from said valve position control circuit to said controller in serial fashion over a data link.

21. Apparatus according to claim 20 wherein:
(A) said data link includes both primary and redundant balanced transmission lines.

22. Apparatus according to claim 1 which includes:
(A) an operator's panel having a manual control section including means for directly inputting signals simultaneously to all of said valve position control circuit to control the positioning of said valves.

23. Apparatus according to claim 22 which includes:
(A) first and second independent automatic control sections each including operator activated means for altering said set point signals in said programmable computer means of said controller.

24. Apparatus according to claim 23 wherein:
(A) said first automatic control section includes
(i) a first pushbutton, activation of which increases the numerical value of a set point signal,
(ii) a second pushbutton, activation of which decreases the numerical value of a set point signal.

25. Apparatus according to claim 23 wherein:
(A) said second automatic control section includes a keyboard entry system whereby an operator may input a new numerical value, by number, to replace a set point signal.

26. Apparatus according to claim 25 which includes:
(A) a CRT in cooperative relationship with said second automatic control section and operative to display predetermined operator selected parameters stored in said programmable digital computer means of said controller.

27. Apparatus according to claim 23 wherein:
(A) each said control section has an associated display; and
(B) the display for said manual control section is operable to display either presumed valid turbine speed (RPM) or generator load (MW).

28. Apparatus according to claim 27 wherein:
(A) the display for said first automatic control section is operable to display either a turbine speed set point (RPM) or a generator load set point (MW).

29. Apparatus according to claim 28 wherein:
(A) said display for said first automatic mode is additionally operable to display RPM/min or MW/min set points.

30. Apparatus according to claim 29 wherein:
(A) the display for said second automatic control section is a CRT the formatting of which is governed by said controller.

31. Apparatus according to claim 1 wherein:
(A) said controller includes means for transmitting and receiving digital information to and from other computer systems.

32. A steam turbine-generator power plant comprising:
(A) a steam turbine having a high pressure section and at least a lower pressure section;
(B) an electric generator rotated by said turbine to generate electric power when connected to a load;
(C) means for providing motive steam;
(D) a plurality of steam admission valves for controllably admitting said steam to said turbine;

(E) a reheater section in the steam flow path between said high and lower pressure turbine sections;

(F) interceptor valve means for admitting reheated steam to said lower pressure turbine section;

(G) a controller including programmable digital computer means operable to receive and store input target set point signals being responsive to said signals to generate a plurality of digital valve control signals;

(H) each said steam admission valve including a valve actuation circuit operable, in response to a valve position control signal, to position the valve so as to control its degree of opening;

(I) position detection means coupled to each said valve to provide respective feedback signals indicative of valve position;

(J) means for providing a turbine speed indicative signal;

(K) an overspeed protection controller circuit including programmable digital computer means responsive to said turbine speed indicative signal and operable to provide a first RPM turbine speed signal;

(L) means, when said generator is connected to said load, to derive an MW load signal;

(M) said overspeed protection controller circuit being responsive to said MW signal and a predetermined turbine pressure condition to control the closing and any subsequent opening of said interceptor valve means.

33. Apparatus according to claim 32 wherein:

(A) said MW signal is placed into storage in said programmable digital computer means of said overspeed protection controller circuit;

(B) said programmable digital computer means of said overspeed protection controller circuit being operable to transmit the value of said MW signal back to said controller.

34. A control system for a steam turbine operative to drive an electric generator and having a plurality of steam admission valves which are controllable in position to determine the operating level of the turbine, comprising:

(A) a controller including programmable digital computer means operable to receive and store input target set point signals and being responsive to said signals to generate a plurality of digital valve control signals;

(B) each said steam admission valve including a valve actuation circuit operable, in response to a valve position control signal, to position the valve so as to control its degree of opening;

(C) position detection means coupled to each said valve to provide respective feedback signals indicative of valve position;

(D) a plurality of valve position control circuits each including programmable digital computer means operable to receive and store a respective one of said digital valve control signals as well as a respective one of said feedback signals and being responsive to said digital valve control and feedback signals to generate a respective one of said valve position control signals;

(E) said control system being operable in a selective one of a manual or automatic mode of operation;

(F) manual input means operable, when in said manual mode of operation, to modify the values of said stored digital valve control signals of all of said valve position control circuits;

(G) said programmable digital computer means of said valve position control circuits being operable to transmit its respective modified control signal back to said controller.

35. Apparatus according to claim 34 wherein:

(A) said manual input means is additionally operable to modify said values of said stored digital valve control signals at a selected one of a plurality of predetermined rates.

36. A control system for a steam turbine operative to drive an electric generator and having a plurality of steam admission valves which are controllable in position to determine the operating level of the turbine, comprising:

(A) a controller including programmable digital computer means operable to receive and store input target set point signals and being responsive to said signals to generate a plurality of digital valve control signals;

(B) each said steam admission valve including a valve actuation circuit operable, in response to a valve position control signal, to position the valve so as to control its degree of opening;

(C) position detection means coupled to each said valve to provide respective feedback signals indicative of valve position;

(D) a plurality of valve position control circuits each including programmable digital computer means operable to receive and store a respective one of said digital valve control signals as well as a respective one of said feedback signals and being responsive to said digital valve control and feedback signals to generate a respective one of said valve position control signals;

(E) a plurality of transducers positioned to provide respective output signals indicative of turbine speed;

(F) a plurality of overspeed protection controller circuits each including programmable digital computer means operable to provide a presumed valid RPM turbine speed signal in response to at least a respective one of said transducer output signals and the presumed valid RPM turbine speed signal from at least one other overspeed protection controller circuit of said plurality.

(G) said programmable digital computer means of an overspeed protection controller circuit, being in digital communication with said controller and being operable to transmit said presumed valid RPM turbine speed signal back to said controller.

* * * * *